US009126240B2

(12) United States Patent
Takebe et al.

(10) Patent No.: US 9,126,240 B2
(45) Date of Patent: Sep. 8, 2015

(54) INTERMEDIATE STORAGE DEVICE OF ELECTROSTATIC COATING SYSTEM , METHOD FOR CLEANING THE SAME, AND METHOD FOR COATING

(71) Applicant: HONDA MOTOR CO., LTD., Tokyo (JP)

(72) Inventors: Masashi Takebe, Tochigi (JP); Takayuki Ueki, Tochigi (JP); Naoki Kishimoto, Tochigi (JP); Takashi Wakimoto, Tochigi (JP); Toshiyuki Kokubo, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 13/783,800

(22) Filed: Mar. 4, 2013

(65) Prior Publication Data

US 2013/0230661 A1 Sep. 5, 2013

(30) Foreign Application Priority Data

Mar. 5, 2012 (JP) ..... 2012-048287
Dec. 3, 2012 (JP) ..... 2012-264612

(51) Int. Cl.
*B08B 9/32* (2006.01)
*B08B 9/032* (2006.01)
(Continued)

(52) U.S. Cl.
CPC ..... *B08B 9/032* (2013.01); *B05B 5/1625* (2013.01); *B05B 5/1675* (2013.01); *B05B 12/1418* (2013.01); *B05B 15/02* (2013.01); *B05D 1/007* (2013.01)

(58) Field of Classification Search
CPC ..... B08B 9/032
See application file for complete search history.

(56) References Cited

U.S. PATENT DOCUMENTS 5,727,931 A 3/1998 Lash et al.
7,328,862 B2 * 2/2008 Takebe et al. ..... 239/690
(Continued)

FOREIGN PATENT DOCUMENTS

CN 100400175 C 7/2008
CN 101600508 A 12/2009
(Continued)

OTHER PUBLICATIONS

English machine translation of JP2008-307538A.*
(Continued)

*Primary Examiner* — Michael Barr
*Assistant Examiner* — Jason Riggleman
(74) *Attorney, Agent, or Firm* — Rankin, Hill & Clark LLP

(57) ABSTRACT

The invention provides an intermediate storage device of an electrostatic coating system that can clean efficiently, a method for cleaning the same, and a method for coating. An intermediate storage device 10 comprises: a first hole 141 which is open to a cylinder chamber 14 and is connected to a paint supply source; a second hole 142 which is open to the cylinder chamber 14 and is connected to a coating gun; and a switch means which switches between a first cleaning which cleans the cylinder chamber 14 by supplying cleaning fluid W from the first hole 141 and discharging from the second hole 142 waste fluid that has undergone cleaning and a second cleaning which cleans the cylinder chamber 14 by supplying cleaning fluid W from the second hole 142 and discharging from the first hole 141 waste fluid that has undergone cleaning.

6 Claims, 12 Drawing Sheets

(51) Int. Cl.

| | |
|---|---|
| ***B05D 1/00*** | (2006.01) |
| ***B05B 5/16*** | (2006.01) |
| ***B05B 12/14*** | (2006.01) |
| ***B05B 15/02*** | (2006.01) |

(56) References Cited

U.S. PATENT DOCUMENTS

| | | | |
|---|---|---|---|
| 8,322,301 | B2 | 12/2012 | Nakazono et al. |
| 2006/0177592 | A1 | 8/2006 | Takebe et al. |
| 2009/0178613 | A1 | 7/2009 | Nakazono et al. |

FOREIGN PATENT DOCUMENTS

| | | | | | |
|---|---|---|---|---|---|
| JP | 4-87760 | U | | 7/1992 | |
| JP | 2502905 | Y2 | | 6/1996 | |
| JP | 11-171294 | A | | 6/1999 | |
| JP | 2000-218196 | A | | 8/2000 | |
| JP | 2004-275977 | A | | 10/2004 | |
| JP | 2008-307538 | A | * | 12/2008 | ..... B05B 5/16 |

OTHER PUBLICATIONS

Chinese Office Action mailed Mar. 26, 2015, 8 pages.
Jul. 20, 2015 Japanese Office Action dated Jul. 7, 2015, 3 pages.

* cited by examiner 10
11
12
12a
14
15
121
141
142
110
P
W

INTERMEDIATE STORAGE DEVICE OF ELECTROSTATIC COATING SYSTEM, METHOD FOR CLEANING THE SAME, AND METHOD FOR COATING

This application is based on and claims the benefit of priority from Japanese Patent Application Nos. 2012-048287 and 2012-264612, respectively filed on 5 Mar. 2012 and 3 Dec. 2012, the contents of which are incorporated herein by reference.

BACKGROUND OF THE INVENTION

1. Field of the Invention

The present invention relates to an intermediate storage device of an electrostatic coating system, a method for cleaning the same, and a method for coating.

2. Related Art

Conventionally, an electrostatic coating system of voltage block type is known as an electrostatic coating system for vehicle bodies (refer to Patent Document 1). In this electrostatic coating system, electrically-conductive paint is introduced into an intermediate storage device, which is insulated from ground potential, from a paint supply source and is stored temporarily. Thereafter, voltage block is provided by cleaning and drying the supply route that connects the intermediate storage device and the paint supply source, and the intermediate storage device and the paint supply source are insulated electrically. Then, electrostatic coating is applied to the object to be coated by applying high voltage to the electrically-conductive paint and supplying the paint to the coating gun in this state.

Meanwhile, when changing the coating color in the above-described electrostatic coating system, electrically-conductive paint of next coating color is introduced after cleaning the intermediate storage device. At this time, when the cleaning of the intermediate storage device is insufficient, the coating color to be painted next and the coating color last painted are mixed together. In addition, the cycle time lengthens if time is spent on cleaning in order to sufficiently clean the intermediate storage device. Patent Document 1 discloses injecting cleaning fluid into a cylinder chamber where paint is stored from an injection hole which is open to the cylinder chamber to clean the cylinder chamber and discharging from a discharge hole waste fluid that has undergone cleaning.

Patent Document 1: Japanese Unexamined Patent Application, Publication No. 2004-275977

SUMMARY OF THE INVENTION

However, the cleaning fluid injected into the cylinder chamber from an injection hole flows into a discharge hole while extruding the paint remaining in the cylinder chamber. That is, the paint remaining in the cylinder chamber serves as resistance to the flow of the cleaning fluid. At this time, the cleaning fluid flows through a shortest route that connects the injection hole and the discharge hole linearly while extruding the remained paint, and when the cleaning of the shortest route is completed, the cleaning fluid continues to flow through this shortest route in which resistance has became smaller. Therefore, there is a problem in that it takes time for cleaning other parts, especially, side parts between the injection hole and the discharge hole (Position P described in FIG. 4B, which will be described later).

In addition, paint has characteristics of having different viscosity for each type (paint type such as coating color, intermediate coating, and finishing coating). Therefore, according to the type of paint, it is necessary to adjust the supply pressure of the cleaning fluid and the depression position (cleaning position) of the piston and reduce the loss of the cleaning fluid and the paint. However, it is difficult to perform such adjustments appropriately for each type of paint.

The present invention has been achieved in view of the above and an object of the present invention is to provide an intermediate storage device of an electrostatic coating system that can clean efficiently, a method for cleaning the same, and a method for coating.

In order to accomplish the above-described object, an embodiment of the present invention provides an intermediate storage device (e.g., the below-described intermediate storage device 10) of an electrostatic coating system (e.g., the below-described electrostatic coating system 1), comprising: a cylinder (e.g., the below-described cylinder 11) which is provided between a paint supply source (e.g., the below-described color switching valve mechanism 20) and a coating gun (e.g., the below-described coating gun 60) and stores paint; a piston (e.g., the below-described piston 12) which can slide inside a cylinder chamber (e.g., the below-described cylinder chamber 14) of the cylinder; a driving source (e.g., the below-described servo-motor 13) which drives the piston. An intermediate storage device of an electrostatic coating system according to an embodiment of the present invention comprises: a first hole (e.g., the below-described first hole 141) which is open to the cylinder chamber and is connected to the paint supply source; a second hole (e.g., the below-described second hole 142) which is open to the cylinder chamber and is connected to the coating gun; a first cleaning means (e.g., the below-described control device 70, first cleaning valve 21, and second dumping valve 41) which cleans the cylinder chamber by supplying cleaning fluid from the first hole and discharging from the second hole waste fluid that has undergone cleaning; a second cleaning means (e.g., the below-described control device 70, second cleaning valve 51, and first dumping valve 31) which cleans the cylinder chamber by supplying cleaning fluid from the second hole and discharging from the first hole waste fluid that has undergone cleaning; and a switch means (e.g., the below-described control device 70, first cleaning valve 21, second dumping valve 41, second cleaning valve 51, and first dumping valve 31) which switches between cleaning performed by the first cleaning means and cleaning performed by the second cleaning means.

In an intermediate storage device of the electrostatic coating system according to an embodiment of the present invention, there are provided: a first hole which is open to the cylinder chamber and is connected to the paint supply source; and a second hole which is open to the cylinder chamber and is connected to the coating gun. In addition, the cylinder chamber is cleaned by switching between supply of cleaning fluid from the first hole and supply of cleaning fluid from the second hole. If the cleaning fluid is supplied only from one hole as in a conventional technique, it takes time for cleaning the intermediate part at the side of the other hole (the below-described position P illustrated in FIG. 4B). In contrast, according to the present invention, after supplying the cleaning fluid for a specific time period from one of the holes, the cleaning fluid is supplied for a specific time period from the other hole and thus the paint remaining near both holes can be discharged efficiently. Therefore, according to the present invention, it is possible to provide an intermediate storage device of an electrostatic coating system that can clean efficiently.

Here, it is preferable if the opening diameter of the first hole and the opening diameter of the second hole are different.

In this embodiment, the opening diameter of the first hole and the opening diameter of the second hole are different. Thereby, when the cleaning fluid is supplied from a hole having larger opening diameter and the waste fluid that has undergone cleaning is discharged from a hole having smaller opening diameter, pressure at the discharge side, that is, back pressure, increases. Therefore, it is possible to prevent the cleaning fluid from flowing only through portions where resistance is small to be discharged out and thus it is possible to clean the entire cylinder chamber efficiently.

Here, it is preferable if the device further includes an annular seal member which fits into an outer peripheral of the extreme end of the piston (e.g., the below-described a seal member 15), and an extreme end surface of the seal member (e.g., the below-described extreme end surface 150 of the seal member 15) is provided substantially in-plane with an extreme end surface of the piston (e.g., the below-described extreme end surface 12*a* of the piston).

In this embodiment, the extreme end surface of the annular seal member which fits into the outer peripheral of the extreme end of the piston is substantially in-plane with the extreme end surface of the piston. Accordingly, the length of the cylinder chamber where the paint is stored in the cylinder axis direction is substantially uniform. Therefore, the resistance with respect to the cleaning fluid that flows through the cylinder chamber is substantially uniform and the cylinder chamber can be cleaned more efficiently by uniformly distributing the cleaning fluid in the entire cylinder chamber.

Here, it is preferable to further include a driving source control means (e.g., the below-described control device 70) which controls the driving source to drive the piston during the cleaning performed by the first cleaning means and the cleaning performed by the second cleaning means.

In this embodiment, the piston is driven when supplying the cleaning fluid from the first hole and when supplying the cleaning fluid from the second hole. Thereby, since the paint remaining in the cylinder chamber can be agitated to lower the viscosity by supplying the cleaning fluid while changing the volume of the cylinder chamber, the cylinder chamber can be cleaned more efficiently.

It is preferable to have a displacement mechanism (e.g., the below-described displacement mechanisms 17 and 97) which displaces the position of the extreme end surface of the piston with respect to the cylinder by displacing the position of the extreme end surface of the piston with respect to the body of the piston (e.g., the below-described piston bodies 120 and 920).

In an embodiment, there is provided a displacement mechanism which displaces the position of the extreme end surface of the piston with respect to the cylinder by displacing the position of the extreme end surface of the piston with respect to the body of the piston when the pressure in the intermediate storage device exceeds predetermined pressure by the cleaning fluid being filled in the intermediate storage device.

According to an embodiment, when the paint remaining in the intermediate storage device serves as resistance to the flow of the cleaning fluid and the pressure in the intermediate storage device increases to exceed the predetermined pressure at the time of cleaning, the position of the extreme end surface of the piston with respect to the cylinder is displaced automatically without controlling due to the displacement of the position of the extreme end surface of the piston with respect to the body of the piston. Thereby, since the volume in the intermediate storage device increases and the amount of the cleaning fluid with respect to the paint remaining in the intermediate storage device increases to reduce the viscosity of the paint, it is possible to improve cleaning efficiency. Therefore, according to the present invention, it is possible to clean inside the intermediate storage device effectively irrespective of the type of the paint.

Here, it is preferable to further include a control means (e.g., the below-described control device 70) which controls a displacement mechanism (e.g., the below-described displacement mechanism 97) such that the position of the extreme end surface of the piston (e.g., the below-described extreme end surface 92*a* of the piston) with respect to the body of the piston (e.g., the below-described piston body 920) is not displaced during the coating.

In this embodiment, control is performed such that the position of the extreme end surface of the piston with respect to the body of the piston is not displaced during the coating, that is, when extruding the paint filled in the intermediate storage device.

According to this embodiment, since the position of the extreme end surface of the piston with respect to the body of the piston is not displaced during the coating, it is possible to supply exact amount of paint to the coating gun.

In addition, there is provided a method for cleaning an intermediate storage device of an electrostatic coating system including: a cylinder that is provided between a paint supply source and a coating gun; a piston which can slide inside a cylinder chamber of the cylinder and; a driving source which drives the piston. A method for cleaning an intermediate storage device of an electrostatic coating system according to this embodiment cleans the cylinder chamber by switching between the supply of cleaning fluid from a first hole which is open to the cylinder chamber and is connected to the paint supply source and the supply of cleaning fluid from a second hole which is open to the cylinder chamber and is connected to the coating gun.

Here, it is preferable to clean the cylinder chamber by making different the opening diameter of the first hole and the opening diameter of the second hole.

Here, it is preferable to clean the cylinder chamber by arranging the seal member such that the extreme end surface of the annular seal member which fits into the outer peripheral of the extreme end of the piston is substantially in-plane with the extreme end surface of the piston.

Here, it is preferable to clean the cylinder chamber by driving the piston with the driving source during the supply of the cleaning fluid from the first hole and during the supply of the cleaning fluid from the second hole.

The above methods for cleaning the intermediate storage device of the electrostatic coating systems exert the same advantageous effects as the above intermediate storage devices of the electrostatic coating system.

In addition, there is provided a method for coating that use an electrostatic coating system (e.g., the below-described electrostatic coating device 1) including: a paint supply source (e.g., the below-described paint tank and the color switching valve mechanism 20); a coating gun (e.g., the below-described coating gun 60); and an intermediate storage device (e.g., the below-described intermediate storage devices 10 and 90) provided between the coating gun and the paint supply source; wherein the intermediate storage device includes a cylinder (e.g., the below-described cylinder 11) and a piston (e.g., the below-described pistons 12 and 92) which can slide inside the cylinder, and the method includes: a step of filling the cleaning fluid (e.g., the below-described cleaning fluid W) in the cylinder chamber (e.g., the below-described cylinder chamber 14) formed between the cylinder and the extreme end surface of the piston (e.g., the below-described extreme end surfaces 12*a* and 92*a*); and a step of displacing the position of the extreme end surface of the piston with respect to the cylinder.

In this method for coating, the cleaning fluid is filled in the intermediate storage device at the time of cleaning, and the position of the extreme end surface of the piston with respect to the cylinder is displaced. Thereby, as in the above embodiments, it is possible to clean inside the intermediate storage device effectively irrespective of the type of the paint.

According to the present invention, it is possible to provide an intermediate storage device of an electrostatic coating system that can clean efficiently, a method for cleaning the same, and a method for coating.

BRIEF DESCRIPTION OF THE DRAWINGS

FIGS. 3A-3C depict diagrams for illustrating routes of the cleaning fluid, wherein FIG. 3A is a diagram showing routes of the cleaning fluid when a supply hole and a discharge hole of the same opening diameter are provided at positions substantially symmetrical with each other with respect to the center of the extreme end of the cylinder near the periphery edge of the extreme end of the cylinder, and FIGS. 3B and 3C are diagrams showing the relation between the route resistance and the discharge resistance for each route;

FIGS. 4A-4B depict diagrams for illustrating a first cleaning according to the first embodiment, wherein FIG. 4A is a diagram showing the flow of the cleaning fluid when performing the first cleaning, and FIG. 4B is a diagram showing a situation of the cleaning when performing the first cleaning;

FIGS. 5A-5B depict diagrams for illustrating a second cleaning according to the first embodiment, wherein FIG. 5A is a diagram showing the flow of the cleaning fluid when performing the second cleaning, and FIG. 5B is a diagram showing a situation of the cleaning when performing the second cleaning;

FIGS. 6A-6B depict diagrams showing the relation between the opening diameter of the first hole and the opening diameter of the second hole, wherein FIG. 6A is a diagram showing a situation of the cleaning when the first hole and the second hole of the same opening diameter are provided, and FIG. 6B is a diagram showing a situation of the cleaning when the opening diameter of the second hole is made smaller than the opening diameter of the first hole;

FIGS. 8A-8D depict cross-sectional views showing a situation of the cleaning upon sliding the piston when performing the first cleaning, wherein FIG. 8A shows a situation when supply of the cleaning fluid from the first hole has begun, FIG. 8B shows a situation when the piston is retreated with respect to the cylinder, FIG. 8C shows a situation when the retreat of the piston with respect to the cylinder is stopped, and FIG. 8D shows a situation when advancing the piston with respect to the cylinder;

DETAILED DESCRIPTION OF THE INVENTION

Figure 1:
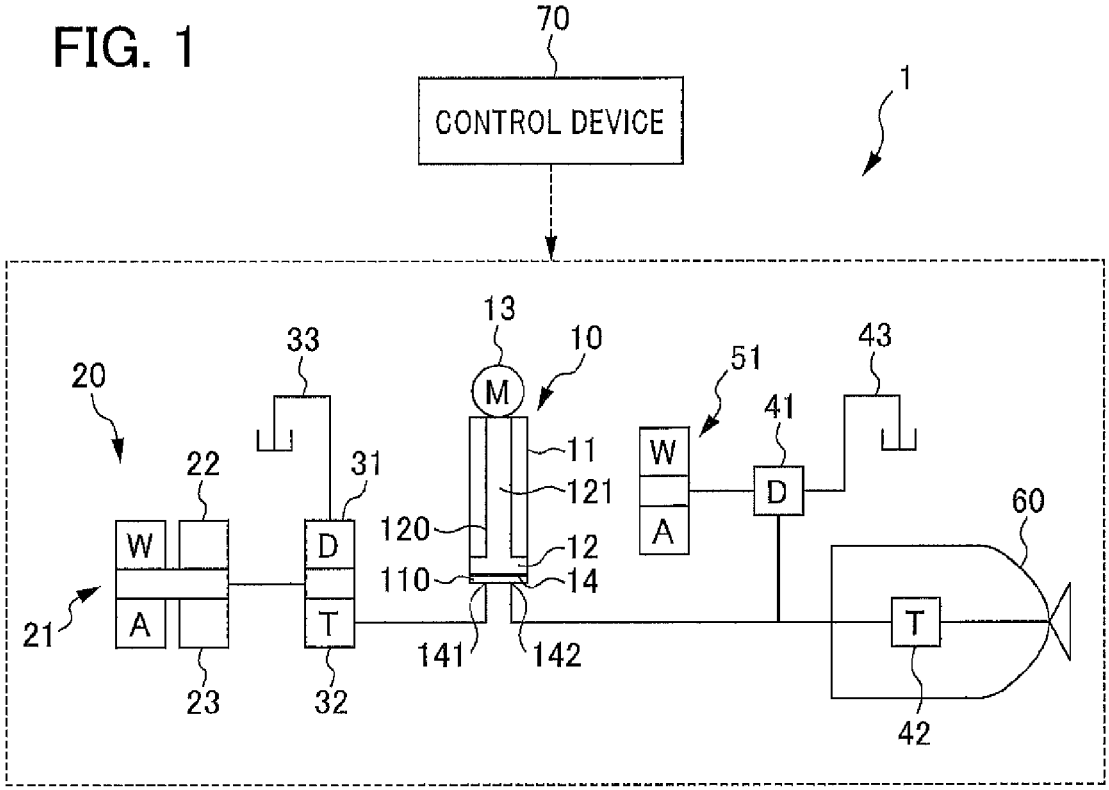
FIG. 1 is a schematic structural diagram of an electrostatic coating system including an intermediate storage device according to a first embodiment.

Embodiments of the present invention will be described in detail with reference to the drawings. It should be noted that, in the description after that of the first embodiment, the same reference numeral is assigned for a structure in common with the first embodiment and the description thereof is omitted.

First Embodiment

FIG. 1 is a schematic structural diagram of an electrostatic coating system 1 including the intermediate storage device 10 according to the first embodiment of the present invention. The intermediate storage device 10 according to this embodiment can perform a method for cleaning according to an embodiment of the present invention.

The electrostatic coating system 1 includes: a color switching valve mechanism 20 including a first cleaning valve 21; a first dumping valve 31; a first trigger valve 32; an intermediate storage device 10; a second dumping valve 41; a second trigger valve 42; a second cleaning valve 51; a coating gun 60; and a control device 70.

The color switching valve mechanism 20 is grounded and is connected to a first hole 141 of the intermediate storage device 10, which will be described later. The color switching valve mechanism 20 includes a first cleaning valve 21 and a plurality of paint valves 22 and 23.

A cleaning fluid tank and an air supply source (not illustrated) are connected to the first cleaning valve 21 and the first cleaning valve 21 controls the supply of the cleaning fluid W and the drying air A. A plurality of paint tanks (not illustrated) are connected to a plurality of paint valves 22 and 23 and the plurality of paint valves 22 and 23 control supply of the electrically-conductive paint of different paint colors.

A first discharge path 33 is connected to the first dumping valve 31. By the second cleaning valve 51, which will be described later, the cleaning fluid W supplied to the cylinder chamber 14 of the intermediate storage device 10, which will be described later, cleans the cylinder chamber 14 to become waste fluid and is discharged through the first dumping valve 31 and the first discharge path 33.

The first trigger valve 32 controls the supply of the electrically-conductive paint from the plurality of paint valves 22 and 23 of the color switching valve mechanism 20. In addition, the first trigger valve 32 controls the supply of the cleaning fluid W and the drying air A from the first cleaning valve 21 of the color switching valve mechanism 20.

The intermediate storage device 10 includes the cylinder 11, the piston 12, and the servo-motor 13. In the present embodiment, the intermediate storage device 10 is provided in a robot arm (not illustrated) and its direction can be changed freely.

The cylinder 11 is substantially cylindrical-shaped and is made of insulating resin. In the cylinder 11, the cylinder chamber 14 in which electrically-conductive paint is stored is formed by the piston 12. The first hole 141 and the second hole 142 which are open to the cylinder chamber 14 are formed at the extreme end 110 of the cylinder 11.

The first hole 141 is connected to the color switching valve mechanism 20, and the second hole 142 is connected to the coating gun 60, which will be described later.

The piston 12 is made of insulating resin and the piston rod 121 is connected to the piston 12. The servo-motor 13 is connected to the piston rod 121 through a ball screw mechanism (not illustrated) and the piston 12 can slide inside the cylinder chamber 14 by driving the servo-motor 13.

A voltage block mechanism (not illustrated) is provided between the color switching valve mechanism 20 and the intermediate storage device 10. As a result of the color switching valve mechanism 20 and the intermediate storage device 10 being insulated electrically with the voltage block mechanism, it is possible to apply high voltage to the electrically-conductive paint by a coating gun 60, which will be described later, connected to the intermediate storage device 10.

The second discharge path 43 is connected to the second dumping valve 41. By the first cleaning valve 21, the cleaning fluid W supplied to the cylinder chamber 14 of the intermediate storage device 10 cleans the cylinder chamber 14 to change into waste fluid and is discharged through the second dumping valve 41 and the second discharge path 43.

The second trigger valve 42 controls the supply of the electrically-conductive paint to the coating gun 60, which will be described later. In addition, The second trigger valve 42 controls the supply of the cleaning fluid W and the drying air A from the second cleaning valve 51, which will be described later.

The second cleaning valve 51 is connected to the cleaning fluid tank and the air supply source (not illustrated) and controls the supply of the cleaning fluid W and the drying air A.

The coating gun 60 is connected to the second hole 142 of the intermediate storage device 10. The coating gun 60 is provided in the robot arm (not illustrated) and includes a high voltage application unit (not illustrated). The electrically-conductive paint supplied to the coating gun 60 through the second trigger valve 42 is blown off from the extreme end of the coating gun 60 in a situation where high voltage is applied by the high voltage application unit.

The control device 70 controls the color switching valve mechanism 20, the first dumping valve 31, the first trigger valve 32, the intermediate storage device 10, the second dumping valve 41, the second trigger valve 42, the second cleaning valve 51, and the coating gun 60. Specifically, the control device 70 controls the supply and the blowoff of the electrically-conductive paint and the supply and the discharge of the cleaning fluid W and the drying air A by carrying out opening and closing control of the valves, drive control of the servo-motor 13 of the intermediate storage device 10, and drive control of the coating gun 60. Thereby, it is possible to perform electrostatic coating and cleaning after performing the electrostatic coating and therefore it is possible to switch the coating color.

It should be noted that the control device 70 includes a first cleaning unit which performs a first cleaning that supplies the cleaning fluid W from a first hole 141, and a second cleaning unit which performs a second cleaning that supplies the cleaning fluid W from a second hole 142. In addition, the control device 70 includes a switching unit which performs switching between the first cleaning and the second cleaning, and a driving source control unit which performs drive control of the servo-motor 13 as a driving source.

Next, the intermediate storage device 10 according to the present embodiment will be described in more detail.

Figure 2:
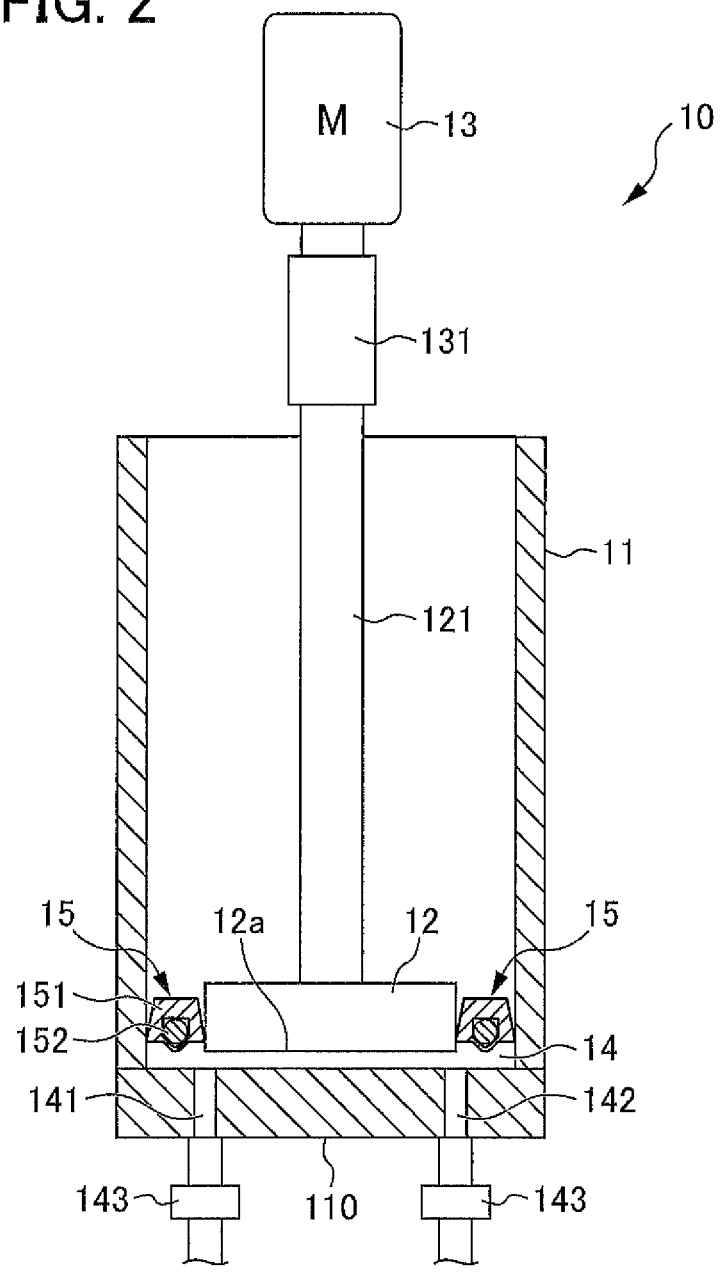
FIG. 2 is a partial cross-sectional view showing a structure of the intermediate storage device according to the first embodiment.

FIG. 2 is a partial cross-sectional view showing a structure of the intermediate storage device 10. More specifically, FIG. 2 shows the intermediate storage device 10 at the time of the cleaning. As shown in FIG. 2, at the time of the cleaning, the piston 12 slides until near the extreme end 110 of the cylinder 11. Therefore, the cylinder chamber 14 is formed by slight clearance between the extreme end surface 12*a* of the piston 12 and the extreme end 110 of the cylinder 11, and electrically-conductive paint remains in the cylinder chamber 14 having small volume.

As described above, the piston rod 121 and the servo-motor 13 are connected through a ball screw mechanism 131. Thereby, as a result of the rotary motion of the servo-motor 13 being converted into rectilinear motion by the ball screw mechanism 131, the piston rod 121 advances and retreats with respect to the cylinder 11 and thus the piston 12 slides inside the cylinder chamber 14.

An annular seal member 15 is fit into the outer peripheral of the extreme end of the piston 12. The seal member 15 has a structure where an O-ring 152 is buried at the extreme end side of the sealing member body 151 made of insulating resin (for example, made of Teflon (registered trademark)).

In addition, the first hole 141 connected to the color switching valve mechanism 20 through the connecting member 143 and the second hole 142 connected to the coating gun 60 through the connecting member 143 are formed near the periphery edge of the extreme end 110 of the cylinder 11 at positions substantially symmetrical with each other with respect to the axis of the cylinder 11. In addition, the first hole 141 and the second hole 142 are respectively provided such that the position of the cylinder 11 in the radial direction is near the boundary between the seal member 15, on which electrically-conductive paint tends to remain, and the outer peripheral of the extreme end of the piston 12. Thereby, since the cleaning fluid W can be supplied toward near such boundary, it is possible to improve cleaning efficiency.

Figure 3A:
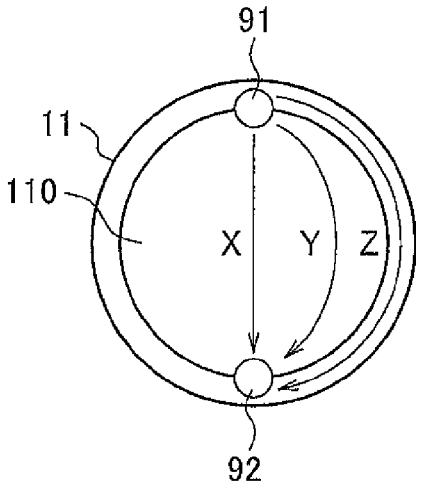
Figure 3B:
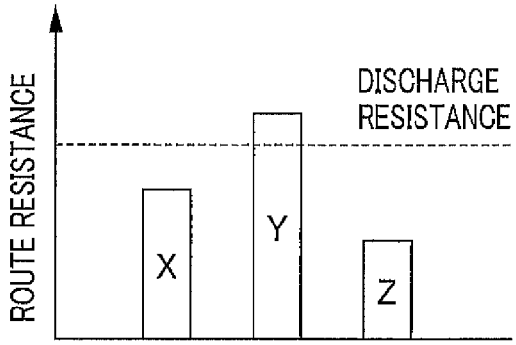
Figure 3C:
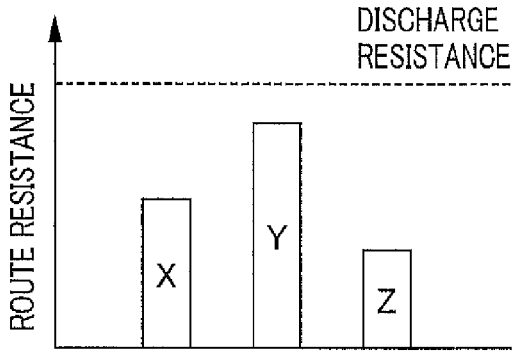

Here, FIGS. 3A-3C depict diagrams for illustrating routes of the cleaning fluid, wherein FIG. 3A is a diagram showing routes of the cleaning fluid W when a supply hole and a discharge hole having the same opening diameter are provided near the periphery edge of the extreme end 110 of the cylinder 11 in positions substantially symmetrical with each other with respect to the center of the extreme end 110 of the cylinder 11. More specifically, FIG. 3A shows a view of the cylinder chamber 14 at the time of cleaning from the base end side of the cylinder 11.

As shown in FIG. 3A, a route that extends substantially linearly through substantially center of the extreme end 110 of the cylinder 11 from the supply hole 91 where the cleaning fluid W is supplied and goes to the discharge hole 92 where the cleaning fluid W is discharged is assumed as Route X. In addition, a route that extends in a curvy shape from the supply hole 91 through near the periphery edge of the extreme end 110 of the cylinder 11 and goes to the discharge hole 92 (i.e., a route corresponding to the position where the seal member 15 is arranged) is assumed as Route Z; and a route that extends in a curvy shape from the supply hole 91 through between Route A and Route C and goes to the discharge hole 92 is assumed as Route Y.

FIGS. 3B and 3C are diagrams showing the relation of route resistance and the discharge resistance for each route. Here, discharge resistance represents resistance at the time when flowing through the discharge hole 92 and indicates magnitude of so-called back pressure. In addition, if a route that has route resistance larger than the discharge resistance, it means that the cleaning fluid W is hard to flow. Therefore, in the case of FIG. 3B, since the route resistance in Route Y is the largest and is larger than the discharge resistance, it can be recognized that the cleaning fluid W is hard to flow through Route Y. In contrast, since the route resistance is smaller than the discharge resistance in Route X and Route Z, it can be recognized that the cleaning fluid W is easy to flow in these routes. Meanwhile, in the case of FIG. 3C, since route resistance in Route Y is smaller than the discharge resistance, it can be recognized that the cleaning fluid W is easy to flow also in Route Y.

It should be noted that the reason why the route resistance in Route Z is smaller than the route resistance in Route X is the following. That is, although Route Z has route length longer than Route X, the clearance between the extreme end 110 of the cylinder 11 and the annular seal member 15 fitting into the extreme end periphery of the piston 12 is larger than the clearance between the extreme end 110 of the cylinder 11 and the extreme end surface 12*a* of the piston 12.

Usually, the cleaning fluid W supplied to the cylinder chamber 14 from the supply hole 91 flows into the discharge hole 92 while extruding the electrically-conductive paint remaining in the cylinder chamber 14. That is, the electrically-conductive paint remaining in the cylinder chamber 14 serves as resistance to the flow of the cleaning fluid W. Here, the cleaning fluid W flows through Route X and Route Z that have small route resistance while extruding the remaining electrically-conductive paint and thus when the cleaning of Route X and Route Z is completed, the cleaning fluid W continues to flow through Route X and Route Z in which resistance has become small. Therefore, cleaning of the electrically-conductive paint remaining in Route Y is promoted by an effect caused by the difference in speed at an interface with the cleaning fluid W that flows through Route X and Route Z and a dissolution effect of the electrically-conductive paint caused by the cleaning fluid at this interface.

However, since it takes time for the physical extrusion in this cleaning, it takes time for cleaning Route Y, especially near the discharge hole 92. In addition, considering the structure of the cylinder 11, the inner diameter of the cylinder 11 is far larger than the opening diameter of the supply hole 91 and the discharge hole 92, and this tendency is more significant as the inner diameter of the cylinder 11 becomes larger as a result of the volume of the cylinder 11 becoming larger and thus it takes time for the cleaning.

Therefore, in the present embodiment, in order to improve the cleaning efficiency of the cylinder chamber 14, the cylinder chamber 14 is cleaned by switching with a switching unit of the control device 70 between a first cleaning which is performed by a first cleaning unit and supplies the cleaning fluid W from the first hole 141 and a second cleaning which is performed by a second cleaning unit and supplies the cleaning fluid W from the second hole 142.

Figure 4A:
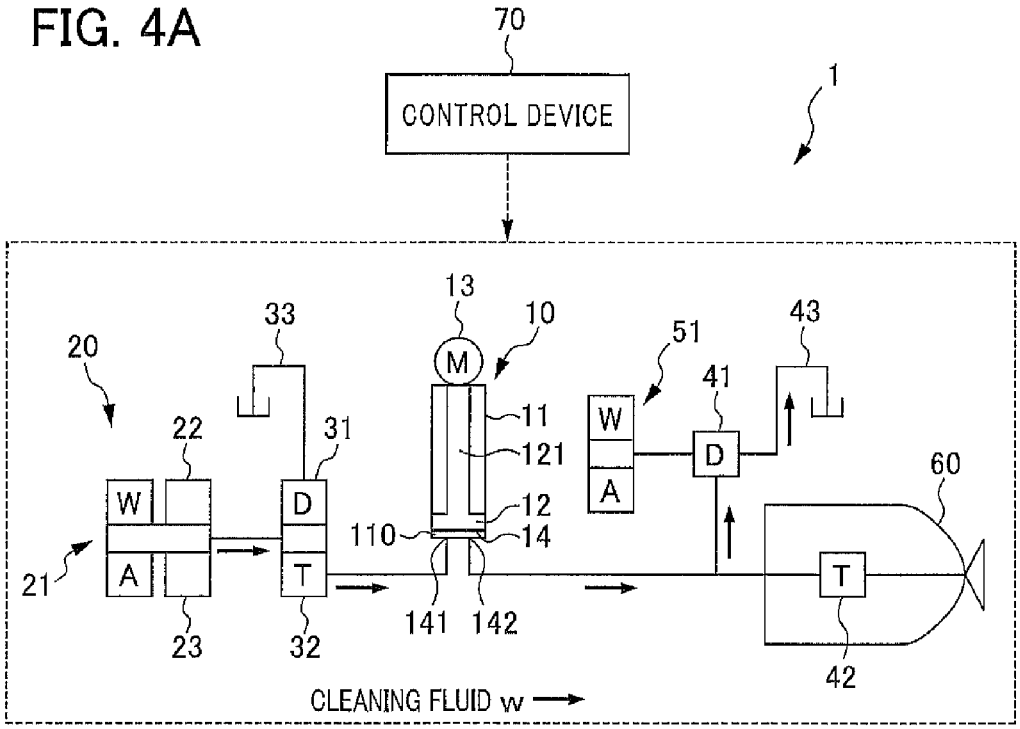
Figure 4B:
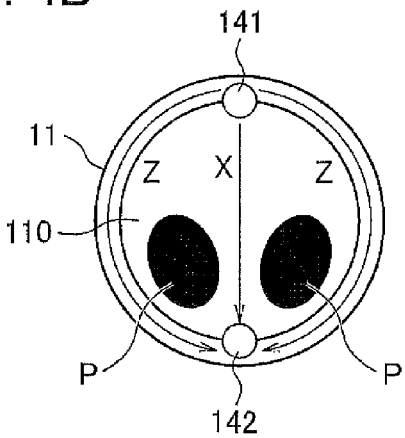

FIGS. 4A-4B depict diagrams for illustrating the first cleaning according to the present embodiment, wherein FIG. 4A is a diagram showing the flow of the cleaning fluid W when performing the first cleaning. As shown in FIG. 4A, in the first cleaning, the cylinder chamber 14 is cleaned by supplying the cleaning fluid W from the first hole 141 by the first cleaning valve 21 of the color switching valve mechanism 20 and discharging from the second hole 142 the waste fluid that has undergone cleaning. At this time, the switching unit of the control device 70 performs the first cleaning by closing the first dumping valve 31 and the second cleaning valve 51 and opening the first cleaning valve 21, the first trigger valve 32, and the second dumping valve 41.

FIG. 4B is a diagram showing a situation of the cleaning when performing the first cleaning. More specifically, FIG. 4B shows a view of the cylinder chamber 14 when performing the first cleaning from the base end side of the cylinder 11. As shown in FIG. 4B, the cleaning fluid W supplied from the first hole 141 flows through Route X and Route Z and is discharged from the second hole 142 as described above. In addition, at this time, although the pressure of the cleaning fluid W is propagated to the circumference substantially uniformly near the first hole 141 at the supply side, the pressure is biased towards the discharge direction gradually as a result of the resistance of the electrically-conductive paint. Therefore, a large amount of electrically-conductive paint P remains between Route X and Route Z especially near the second hole 142 at the discharge side.

Figure 5A:
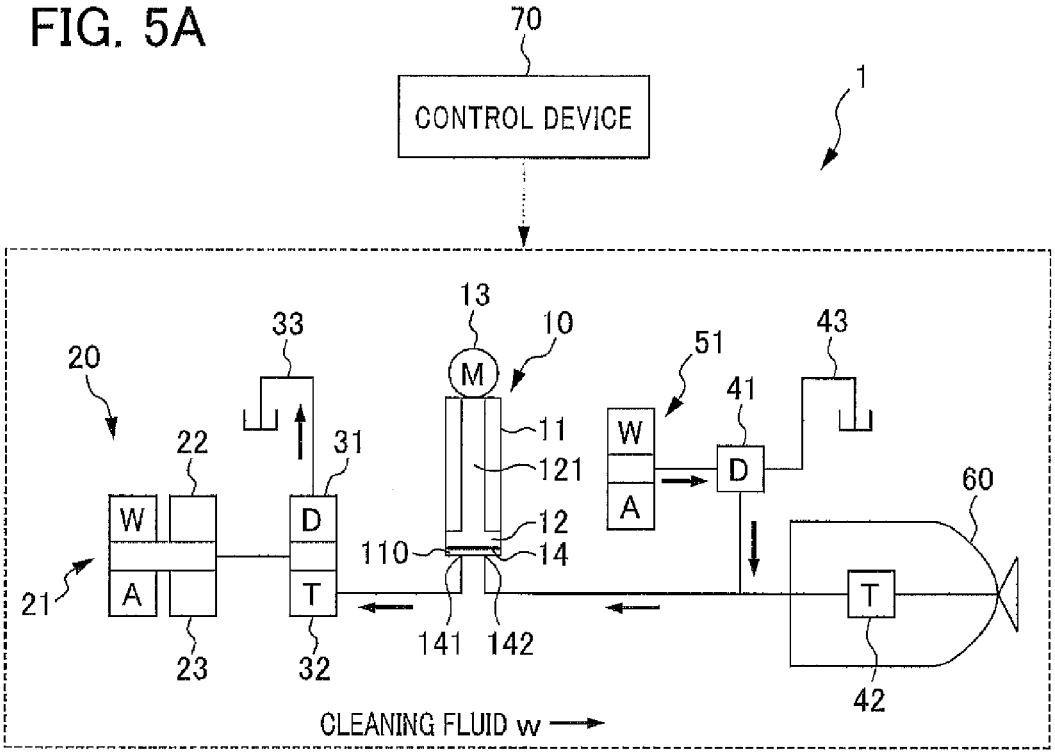
Figure 5B:
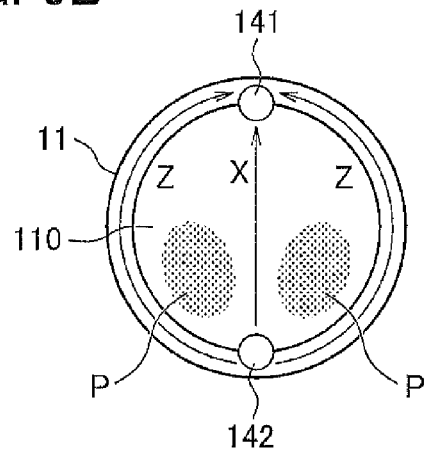

FIGS. 5A-5B depict diagrams for illustrating the second cleaning according to the present embodiment, wherein FIG. 5A is a diagram showing the flow of the cleaning fluid W when performing the second cleaning. As shown in FIG. 5A, in the second cleaning, the cylinder chamber 14 is cleaned by supplying the cleaning fluid W from the second hole 142 with the second cleaning valve 51 and discharging from the first hole 141 the waste fluid that has undergone cleaning. Here, the switching unit of the control device 70 performs the second cleaning by closing the first cleaning valve 21, the first trigger valve 32, and the second dumping valve 41, and opening the first dumping valve 31 and the second cleaning valve 51.

FIG. 5B is a diagram showing a situation of the cleaning when performing the second cleaning. More specifically, FIG. 5B shows a view of the cylinder chamber 14 when performing the second cleaning from the base end side of the cylinder 11. As shown in FIG. 5B, the cleaning fluid W supplied from the second hole 142 flows through Route X and Route Z and is discharged from the first hole 141 as described above. In addition, at this time, since the pressure of the cleaning fluid W is propagated to the circumference substantially uniformly near the second hole 142 of the supply side, the electrically-conductive paint P that has remained largely near the second hole 142 after the first cleaning is performed is extruded to the first hole 141 at the discharge side and discharged out. Thereby, the entire cylinder chamber 14 is cleaned efficiently.

It should be noted that the first cleaning may be further performed after the second cleaning, and the first cleaning and the second cleaning may be repeated alternately. Thereby, the cylinder chamber 14 can be cleaned more efficiently within a range that does not take an excessively long cycle time.

In addition, the duration time of the second cleaning may be shorter than the duration time of the first cleaning. This is because the dissolution of the electrically-conductive paint P that had remained is partly advanced to lower its viscosity and thus it is possible to extrude the electrically-conductive paint P easily.

The electrostatic coating system 1 including the intermediate storage device 10 according to the present embodiment operates as follows.

First, with the control device 70, the first dumping valve 31, the second dumping valve 41, and the second trigger valve 42 are opened and one of the paint valves and the first trigger valve are opened. In addition, the servo-motor 13 of the intermediate storage device 10 is driven by the driving source control unit of the control device 70. Thereby, the electrically-conductive paint of predetermined coating color is pressure-fed into the cylinder chamber 14 of the intermediate storage device 10 and thus the electrically-conductive paint is supplied to the second trigger valve 42.

Subsequently, when the filling of the electrically-conductive paint into the cylinder chamber 14 is completed, a voltage block mechanism (not illustrated) is controlled by the control device 70 such that the color switching valve mechanism 20 and the intermediate storage device 10 are electrically insulated.

Next, with the control device 70, the second trigger valve 42 is opened and the piston 12 is advanced with respect to the cylinder 11 by a drive action of the servo-motor 13. As a result, the electrically-conductive paint stored in the cylinder chamber 14 is pressure-fed towards the coating gun 60. High voltage is applied at a high voltage application unit onto the electrically-conductive paint pressure-fed by the coating gun 60 and at this situation, the electrically-conductive paint is blown off from the extreme end of the coating gun 60 in this state. Thereby, electrostatic coating of the electrically-conductive paint is carried out with respect to the object to be coated.

When newly coating the electrically-conductive paint of different coating color after the electrostatic coating is completed, the second trigger valve 42 is closed with the control device 70 and application of high voltage to the coating gun 60 is canceled. In addition, electric insulation between the color switching valve mechanism 20 and the intermediate storage device 10 by the voltage block mechanism is canceled.

Subsequently, by the switching unit of the control device 70, the first dumping valve 31 and the second cleaning valve 51 are closed, and the first cleaning valve 21, the first trigger valve 32, and the second dumping valve 41 are opened. Thereby, the first cleaning that cleans the cylinder chamber 14 is performed by supplying the cleaning fluid W from the first hole 141 and discharging from the second hole 142 the waste fluid that has undergone cleaning.

After performing the first cleaning for predetermined time period (time period longer than the duration time of the second cleaning in the present embodiment), the first cleaning valve 21, the first trigger valve 32, and the second dumping valve 41 are closed and the first dumping valve 31 and the second cleaning valve 51 are opened by the switching unit of the control device 70. Thereby, the second cleaning that cleans the cylinder chamber 14 is performed by supplying the cleaning fluid W from the second hole 142 and discharging from the first hole 141 the waste fluid that has undergone cleaning.

As described above, after the cylinder chamber 14 is cleaned efficiently, electrostatic coating is performed by newly supplying electrically-conductive paint of different coating color with the same procedure as the above-described procedure.

The present embodiment exerts the following advantageous effects.

In the present embodiment, the first hole 141 which is open to the cylinder chamber 14 and is connected to the color switching valve mechanism 20 which serves as a paint supply source and the second hole 142 which is open to the cylinder chamber 14 and is connected to the coating gun 60 are provided in the intermediate storage device 10 of the electrostatic coating system 1. In addition, the cylinder chamber 14 is cleaned while supply of the cleaning fluid W from the first hole 141 and supply of the cleaning fluid W from the second hole 142 are switched. If the cleaning fluid W is supplied from only one of the holes as in a conventional technique, it takes time for cleaning near the other hole. In contrast, according to the present embodiment, since the cleaning fluid W is supplied for a specific time period from the second hole 142 after supplying the cleaning fluid W from the first hole 141 for a specific time period, the electrically-conductive paint remaining near both holes can be discharged efficiently. Therefore, according to the present embodiment, it is possible to provide an intermediate storage device 10 of the electrostatic coating system 1 that can clean efficiently.

Second Embodiment

This embodiment is different from the first embodiment in that the opening diameter of the first hole 141 and the opening diameter of the second hole 142 are different in order to improve cleaning efficiency of the cylinder chamber 14, and other structure is the same as that of the first embodiment. Specifically, in the present embodiment, the opening diameter of the second hole 142*a* is set smaller than the opening diameter of the first hole 141*a*.

Here, in order to improve cleaning efficiency of the cylinder chamber 14, it is important to diffuse the flow of the cleaning fluid W inside the cylinder chamber 14, and this is made possible by controlling the flow of the cleaning fluid W to the discharge side. Specifically, as a result of raising the back pressure at the discharge side, the residence time period of the cleaning fluid W in a state where the pressure when the cleaning fluid W is supplied to the cylinder chamber 14 is maintained becomes long. If the residence time period of the cleaning fluid W becomes long, it is easier to dissolve the electrically-conductive paint in the resided cleaning fluid W and thus the cleaning efficiency improves.

A conventional technique is known which suppresses the flow of the cleaning fluid W and has longer residence time period of the cleaning fluid W and thus improves cleaning efficiency by making the supply direction and the discharge direction of the cleaning fluid W different. However, with this technique, when an intermediate storage device is provided in a robot arm, for example, and its direction is freely changed, it is not possible to obtain advantageous effects due to the influence of gravity. This becomes increasingly significant if the diameter of the cylinder is larger.

Figure 6A:
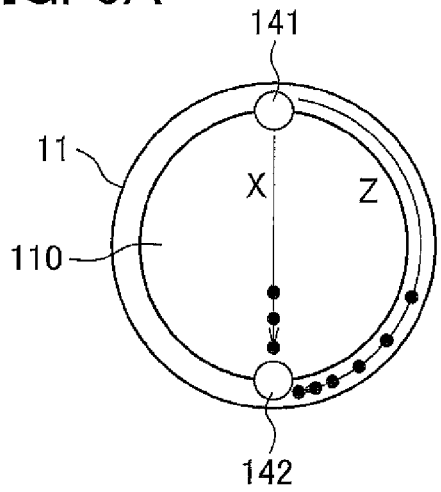
Figure 6B:
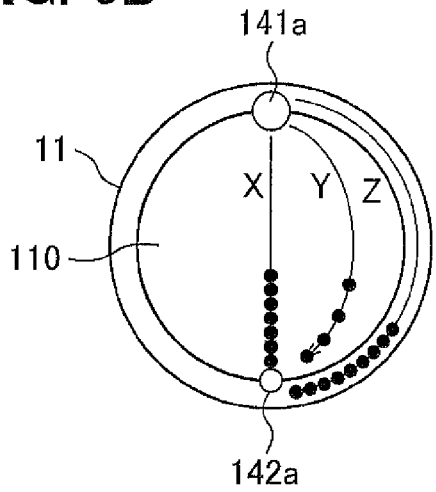

FIGS. 6A-6B depict diagrams showing the relation between the opening diameter of the first hole and the opening diameter of the second hole. FIG. 6A is a diagram showing a situation of the cleaning when the first hole 141 and the second hole 142 having the same opening diameter are provided as in the above-described first embodiment; and FIG. 6B is a diagram showing a situation of the cleaning when the opening diameter of the second hole 142*a* is smaller than the opening diameter of the first hole 141*a*. Such FIGS. 6A and 6B are views of the cylinder chamber 14 from the base end side of the cylinder 11 at the time of cleaning.

As shown in FIG. 6A, when the first hole 141 and the second hole 142 having the same opening diameter are provided, the cleaning fluid W supplied from the first hole 141 flows through Route X and Route Z and is discharged from the second hole 142 as described above. Meanwhile, as shown in FIG. 6B, in the present embodiment where the opening diameter of the second hole 142*a* is smaller than the opening diameter of the first hole 141*a*, the pressure at the discharge side, that is, the back pressure, increases. Therefore, although the flow rate itself of the cleaning fluid W to be discharged decreases, the cleaning fluid W flows also in Route Y where the cleaning fluid W is hard to flow. Thereby, it is possible to prevent the cleaning fluid W from being discharged by flowing only parts where the resistance is small and thus the entire cylinder chamber 14 can be cleaned more efficiently.

In the present embodiment, the opening diameter of the second hole 142*a* is set smaller than the opening diameter of the first hole 141*a*. This is because the duration time of the first cleaning is set longer than the duration time of the second cleaning. That is, in the present embodiment, the above advantageous effect can be sufficiently exerted by supplying the cleaning fluid W for a long time in a state where the back pressure is raised.

However, the present invention is not limited to this and the opening diameter of the first hole 141*a* may be set smaller than the opening diameter of the second hole 142*a*.

Third Embodiment

This embodiment is different from the first embodiment in that, in order to improve cleaning efficiency of the cylinder chamber 14, an annular seal member 15 which fits into the outer peripheral of the extreme end of the piston 12 is arranged such that its extreme end surface 150 is in-plane with the extreme end surface 12*a* of the piston 12, and other structure is the same as that of the first embodiment.

Here, in order to exert the extrusion force of the cleaning fluid W to the utmost, it is important to minimize the amount of the electrically-conductive paint P remaining in the cylinder chamber 14. Therefore, it is desired to minimize the size of the cylinder chamber 14 formed by the clearance between the extreme end surface 12*a* of the piston 12 and the extreme end 110 of the cylinder 11 while securing the flow of the cleaning fluid W at the time of the cleaning. In addition, it is desired to secure clearance equivalent to that of the center part of the piston 12 in the radial direction in order to make the flow of the cleaning fluid W uniform in the outer peripheral of the extreme end of the piston 12 where the annular seal member 15 is located.

Figure 7:
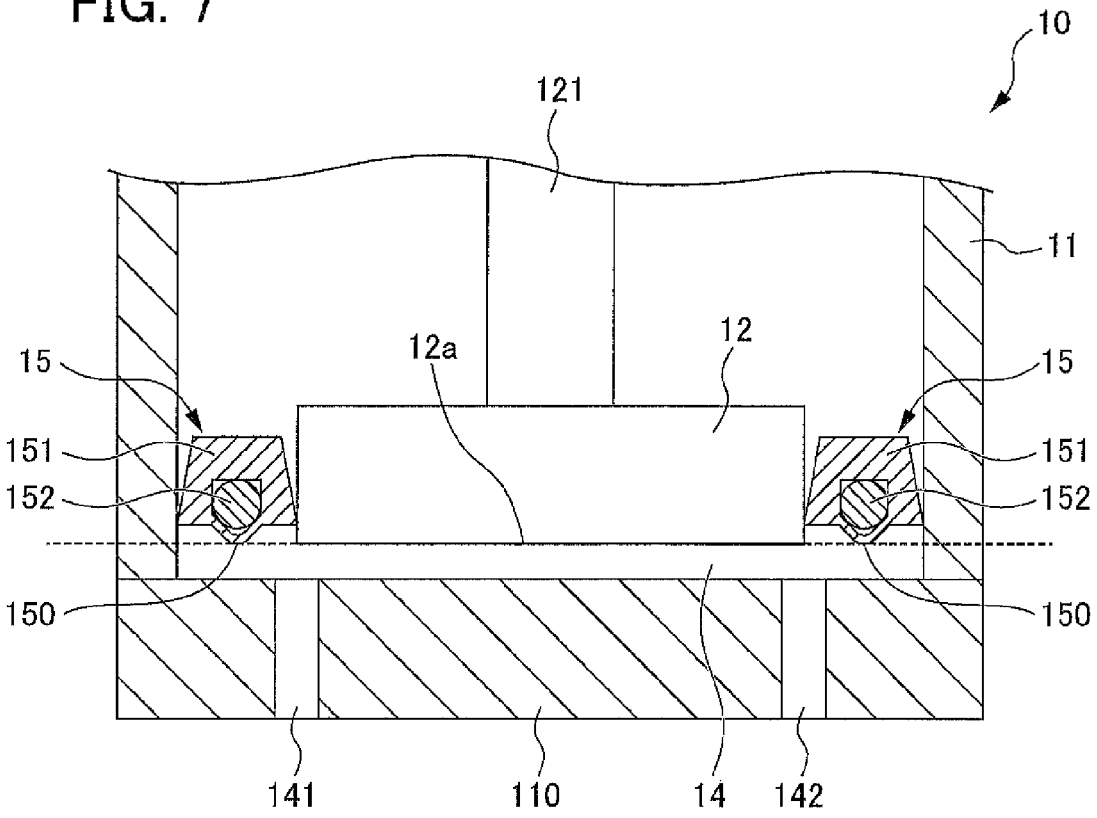
FIG. 7 is a partial cross-section enlarged view of the extreme end of the intermediate storage device according to a third embodiment.

FIG. 7 is a partial cross-section enlarged view of an extreme end of the intermediate storage device 10 according to the present embodiment. As shown in FIG. 7, in the present embodiment, the cylinder chamber 14 is formed by slight clearance between the extreme end surface 12*a* of the piston 12 and the extreme end 110 of the cylinder 11. In addition, the extreme end surface 150 of the annular seal member 15 fit into the outer peripheral of the extreme end of the piston 12 is in-plane with the extreme end surface 12*a* of the piston 12. More specifically, the annular extreme end surface 150 in the buried part of the O-ring 152 is in-plane with the extreme end surface 12*a* of the piston 12.

Thereby, the length of the cylinder chamber 14 where the electrically-conductive paint is stored in the direction of the cylinder axis can be made substantially uniform while securing the flow of the cleaning fluid W. Therefore, the resistance with respect to the cleaning fluid W that flows through the cylinder chamber 14 is substantially uniform and the cleaning fluid W is distributed substantially uniformly in the entire cylinder chamber 14 and thus the entire cylinder chamber 14 can be efficiently cleaned.

Fourth Embodiment

This embodiment is different from the first embodiment in that, in order to improve cleaning efficiency of the cylinder chamber 14, the piston 12 slides by driving the servo-motor 13 during the first cleaning and the second cleaning with the driving source control unit of the control device 70, and other structure is the same as that of the first embodiment.

Here, in order to improve cleaning efficiency of the cylinder chamber 14, it is important to agitate inside the cylinder chamber 14 actively. Conventional techniques are known which promote agitation with an agitator, a straightening vane, or the like but since the structure is complicated in these techniques, it takes considerable time for the cleaning.

FIGS. 8A-8D depict cross-sectional views showing situations of cleaning upon sliding the piston 12 during the first cleaning.

Figures 8A, 8B, 8C, 8D:
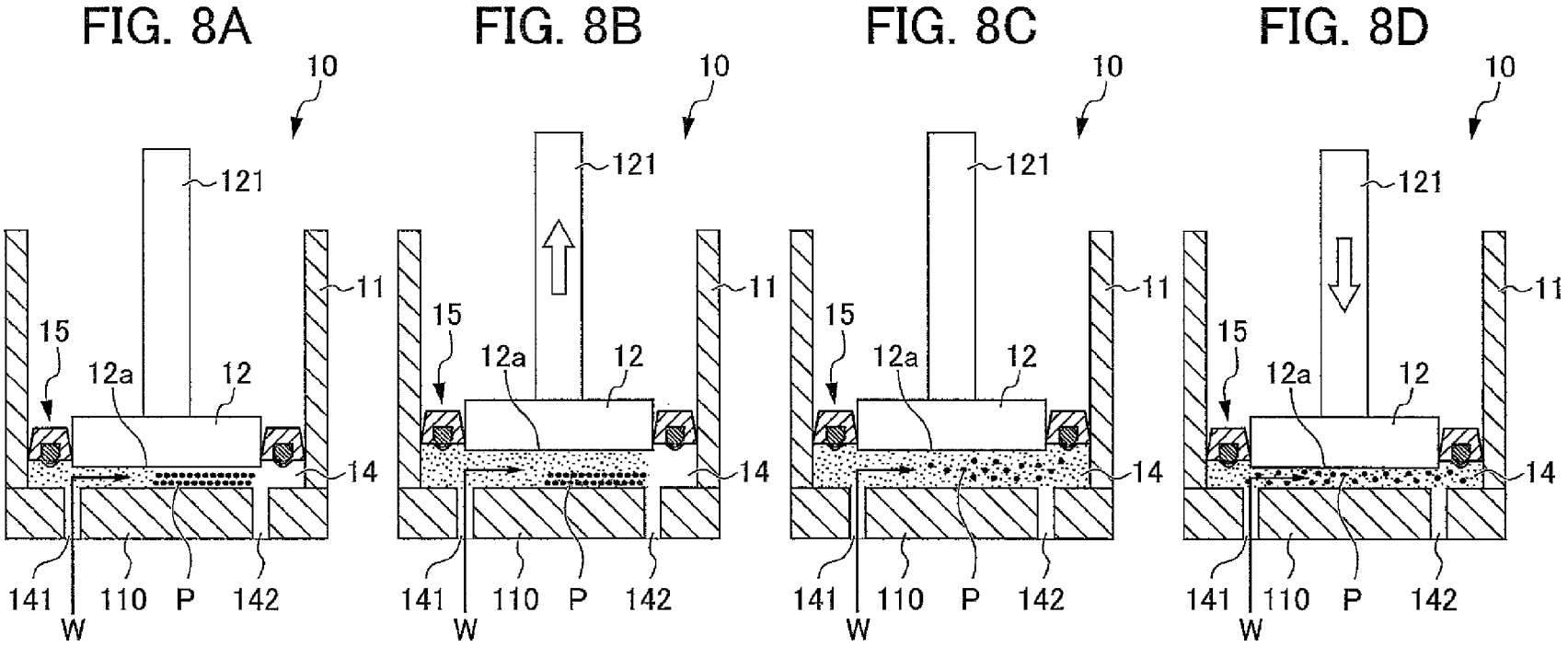

First, FIG. 8A shows a situation when the supply of the cleaning fluid W from the first hole 141 has begun. As described above, a large amount of electrically-conductive paint P remaining in the cylinder chamber 14 exists near the second hole 142.

Next, FIG. 8B shows a situation where the piston 12 slides during the first cleaning and retreats with respect to the cylinder 11. It can be recognized that, as a result of the piston 12 being retreated, the clearance between the extreme end surface 12*a* of the piston 12 and the extreme end 110 of the cylinder 11 becomes large and thus the volume of the cylinder chamber 14 has become larger. Thereby, a large amount of cleaning fluid is introduced into the cylinder chamber 14.

Next, FIG. 8C shows a situation where the retreat of the piston 12 with respect to the cylinder 11 has stopped. It can be recognized that the remaining electrically-conductive paint P is gradually spread in the entire cylinder chamber 14 by an agitation effect as a result of the piston 12 being retreated and the volume of the cylinder chamber 14 being increased. Thereby, the contact area between the remained electrically-conductive paint P and the cleaning fluid W increases and thus the viscosity of the electrically-conductive paint P is lowered by the dissolving ability of the cleaning fluid W.

Next, FIG. 8D shows a situation of sliding the piston 12 again and advancing the piston 12 with respect to the cylinder 11. It can be recognized that, as the piston 12 moves forward, the clearance between the extreme end surface 12*a* of the piston 12 and the extreme end 110 of the cylinder 11 becomes small and thus the volume of the cylinder chamber 14 has become smaller. At this time, the electrically-conductive paint P whose viscosity has been already reduced is further diffused in the entire cylinder chamber 14.

As described above, by supplying the cleaning fluid W while sliding the piston 12 and changing the volume of the cylinder chamber 14, it is possible to agitate the electrically-conductive paint P that remains in the cylinder chamber 14 to thereby reduce the viscosity and thus it is possible to clean the entire cylinder chamber 14 more efficiently.

In the present embodiment, the piston 12 slides during the first cleaning. This is because the duration time of the first cleaning is set longer than the duration time of the second cleaning. That is, in the present embodiment, the above-described advantageous effect can fully be exerted by supplying for a longer time the cleaning fluid W while changing the volume of the cylinder chamber 14.

However, the present invention is not limited to this and the piston 12 may slide during the second cleaning.

Fifth Embodiment

FIG. 1 is a schematic structural diagram of the electrostatic coating device 1 according to the fifth embodiment of the present invention also. The electrostatic coating device 1 according to this embodiment can perform a method for coating according to an embodiment.

The electrostatic coating device 1 includes: an intermediate storage device 10; a color switching valve mechanism 20 including a first cleaning valve 21; a first dumping valve 31; a first trigger valve 32; a second dumping valve 41; a second trigger valve 42; a second cleaning valve 51; a coating gun 60; and a control device 70.

The color switching valve mechanism 20 is grounded and connected to a first hole 141 of the intermediate storage device 10 described in detail in the latter part. The color switching valve mechanism 20 includes the first cleaning valve 21 and a plurality of paint valves 22 and 23.

A cleaning fluid tank and an air supply source (not illustrated) are connected and the first cleaning valve 21 controls the supply of the cleaning fluid W and the drying air A. A plurality of paint tanks (not illustrated) are connected to the plurality of paint valves 22 and 23 and the plurality of paint valves 22 and 23 control supply of electrically-conductive paint of different paint colors.

The second discharge path 43 is connected to the second dumping valve 41. The cleaning fluid W that is supplied to the cylinder chamber 14 of the intermediate storage device 10, which will be described later, by the first cleaning valve 21 cleans the cylinder chamber 14 to become waste fluid and is discharged through the second dumping valve 41 and the second discharge path 43.

The first trigger valve 32 controls the supply of the electrically-conductive paint from the plurality of paint valves 22 and 23 of the color switching valve mechanism 20. In addition, the first trigger valve 32 controls the supply of the cleaning fluid W and the drying air A from the first cleaning valve 21 of the color switching valve mechanism 20.

The intermediate storage device 10 includes a cylinder 11, a piston 12 and a servo-motor 13. In the present embodiment, the intermediate storage device 10 is included in a robot arm (not illustrated) and its direction can be changed freely.

The cylinder 11 is substantially cylindrical-shaped and is made of insulating resin. In the cylinder 11, a cylinder chamber 14 where the electrically-conductive paint is stored is formed inside the extreme end surface 12*a* of the piston 12. The first hole 141 and the second hole 142, which are open to the cylinder chamber 14, are formed at the extreme end 110 of the cylinder 11.

The first hole 141 is connected to the color switching valve mechanism 20 and the second hole 142 is connected to the coating gun 60, which will be described later.

The piston 12 is made of insulating resin and includes a piston body 120 as will be described later. The servo-motor 13 is connected to the piston body 120 via a ball screw mechanism (not illustrated). By driving the servo-motor 13, the rotary motion of the servo-motor 13 is converted into rectilinear motion by the ball screw mechanism. Thereby, the piston 12 can slide inside the cylinder 11 by the piston 12 advancing and retreating with respect to the cylinder 11.

A voltage block mechanism (not illustrated) is provided between the color switching valve mechanism 20 and the intermediate storage device 10. By way of this voltage blocking mechanism, the color switching valve mechanism 20 and the intermediate storage device 10 are insulated electrically with each other and thus it is possible to apply high voltage to the electrically-conductive paint by a coating gun 60, which will be described later, and is connected to the intermediate storage device 10.

The second trigger valve 42 controls the supply of the electrically-conductive paint to the coating gun 60, which will be described later. In addition, the second trigger valve 42 controls the supply of the cleaning fluid W from the second cleaning valve 51 described later and the drying air A.

The cleaning fluid tank and air supply source (not illustrated) are connected to the second cleaning valve 51 and the second cleaning valve 51 controls the supply of the cleaning fluid W and the drying air A.

The coating gun 60 is connected to the second hole 142 of the intermediate storage device 10. The coating gun 60 is provided in the robot arm (not illustrated) and includes the high voltage application unit (not illustrated). The electrically-conductive paint supplied to the coating gun 60 through the second trigger valve 42 is blown off from the extreme end of the coating gun 60 in a state where high voltage is applied by the high voltage application unit.

The control device 70 controls the color switching valve mechanism 20, the first dumping valve 31, the first trigger valve 32, the intermediate storage device 10, the second dumping valve 41, the second trigger valve 42, the second cleaning valve 51 and the coating gun 60. Specifically, the control device 70 controls the supply and injection of the electrically-conductive paint and supply and discharge of the cleaning fluid W and the drying air A by performing opening and closing control of each valve, drive control of the servo-motor 13 of the intermediate storage device 10, drive control of the driving source of the displacement mechanism 17 described later and drive control of the coating gun 60. Thereby, it is possible to perform electrostatic coating and cleaning after the electrostatic coating is performed and thus it is possible to switch the coating color.

It should be noted that, at the time of the cleaning, the control device 70 controls the servo-motor 13 to slide the piston 12 until near the extreme end 110 of the cylinder 11 and stop the drive of the piston 12 and then cleaning is performed in this state.

In addition, during the coating, the control device 70 controls the servo-motor 13 to perform coating while advancing the piston 12 with respect to the cylinder 11.

Hereafter, the intermediate storage device 10 according to the present embodiment will be described in detail.

Figure 9:
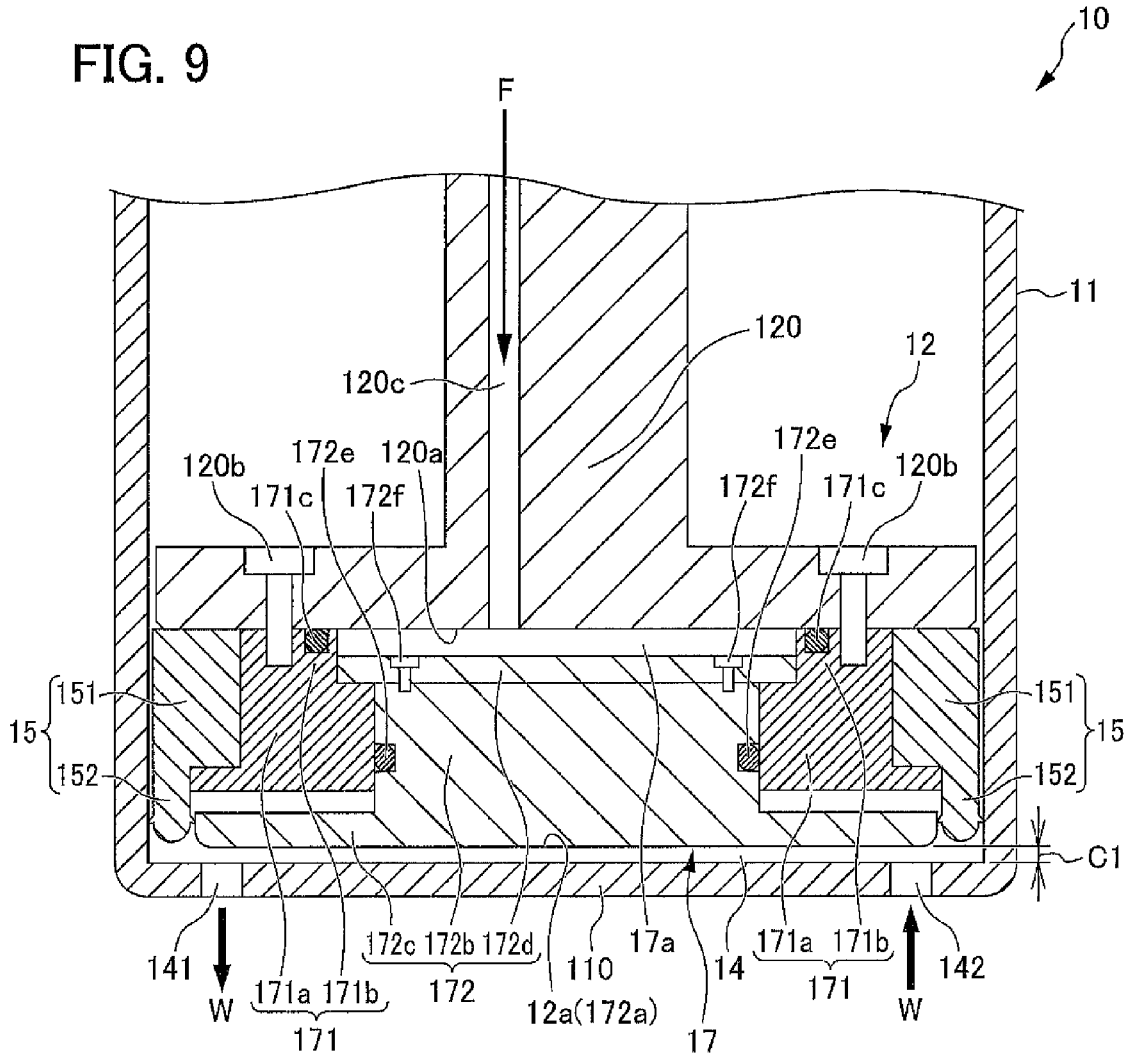
FIG. 9 is an enlarged cross-sectional view of the intermediate storage device according to a fourth embodiment when the pressure in the cylinder chamber is lower than the supply pressure of the fluid supplied into the cylinder chamber at the time of cleaning the low viscosity paint.
Figure 10:
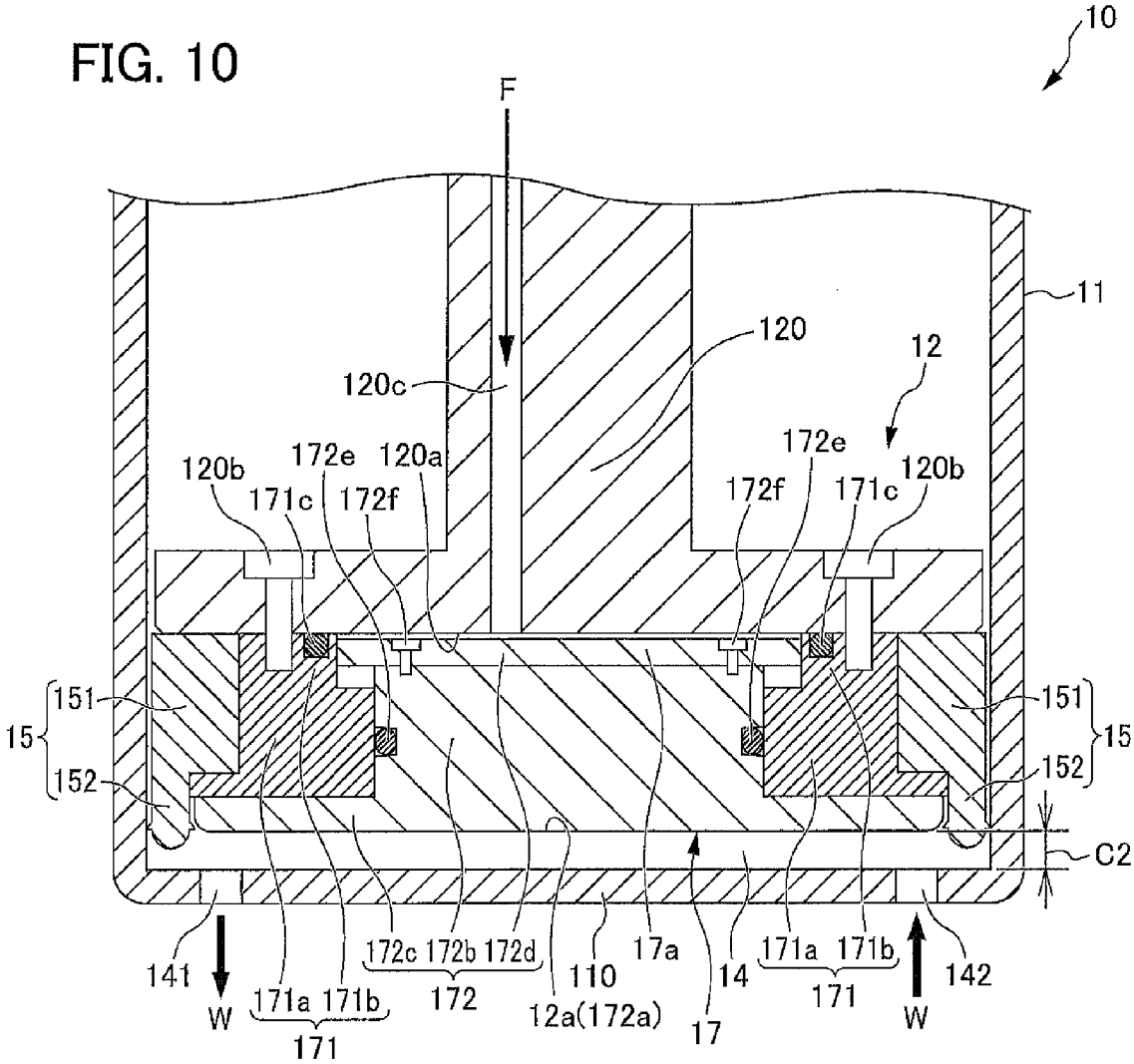
FIG. 10 is an enlarged cross-sectional view of the intermediate storage device according to the fourth embodiment when the pressure in the cylinder chamber is higher than the supply pressure of the fluid supplied into the cylinder chamber at the time of cleaning the high viscosity paint.

FIG. 9 and FIG. 10 are enlarged cross-sectional views showing the structure of the intermediate storage device 10 according to the present embodiment. More specifically, FIG. 9 is an enlarged cross-sectional view of the extreme end of the intermediate storage device 10 when the pressure inside the cylinder chamber 14 is lower than predetermined fixed supply pressure of the fluid F supplied into the cylinder chamber 14 at the time of cleaning the low viscosity paint; and FIG. 10 is an enlarged cross-sectional view of the extreme end of the intermediate storage device 10 when the pressure in the cylinder chamber 14 is higher than the predetermined fixed supply pressure of the fluid F supplied into the cylinder chamber 14 at the time of cleaning the high viscosity paint.

As shown in FIG. 9 and FIG. 10, the piston 12 includes a piston body 120 and a displacement mechanism 17. The position of the extreme end surface 12*a* of the piston 12 is displaced with respect to the cylinder 11 by the displacement mechanism 17 displacing the position of the extreme end surface 12*a* of the piston 12 with respect to the piston body 120.

The piston body 120 can slide inside the cylinder 11.

The displacement mechanism 17 is provided at the extreme end of the piston body 120. The displacement mechanism 17 includes: a cylinder part 171; a displacing part 172; and a driving source that displaces the displacing part 172 (not illustrated).

The cylinder part 171 extends from the extreme end surface 120*a* of the piston body 120 toward the extreme end 110 of the cylinder 11 and is fixed onto the extreme end surface 120*a* with a plurality of bolts 120*b*. The cylinder part 171 includes: a cylinder small diameter part 171*a* which is formed at the extreme end side and has inner diameter smaller than that of the below-described cylinder large diameter part 171*b*; and a cylinder large diameter part 171*b* which is formed at the base end side and has an inner diameter larger than that of the cylinder small diameter part 171*a*.

The seal part 171*c* including a circular O-ring is fit onto the base end side of the cylinder part 171 that contacts with the extreme end surface 120*a* of the piston body 120. Thereby, it is possible to avoid the fluid F supplied from a driving source, which will be described later, from leaking outside.

The displacing part 172 includes: a displacing part body 172*b*; an extreme end flange part 172*c*; and a base end flange part 172*d*.

The displacing part body 172*b* is formed in a substantially cylindrical shape and can slide inside the cylinder part 171. More specifically, the displacing part body 172*b* can slide inside the cylinder small diameter part 171*a* of the cylinder part 171. A seal part 172*e* which includes a circular O-ring is fit onto the periphery of the displacing part body 172*b*. Thereby, it is possible to avoid the fluid F supplied from the driving source, which will be described later, from leaking outside.

The extreme end flange part 172*c* has a flange which is formed at an extreme end of the displacing part body 172*b* and extends outward in the radial direction in the entire circumference. Here, an extreme end surface 12*a* of the piston 12 in the present embodiment indicates an extreme end surface 172*a* (extreme end surface of the extreme end flange part 172*c*) of the displacing part 172.

It should be noted that the above-described cylinder chamber 14 is formed by a space surrounded by the extreme end surface 12*a* (172*a*) of the piston 12 and the extreme end 110 of the cylinder 11.

The base end flange part 172*d* is formed at the base end of the displacing part body 172*b* and has a flange extending the entire circumference in the radial direction. The base end flange part 172*d* is fixed onto the base end surface of the displacing part body 172*b* with a plurality of bolts 172*f*. The base end flange part 172*d* can slide inside the cylinder large diameter part 171*b*. Since the diameter of the base end flange part 172*d* is formed larger than the inner diameter of the cylinder small diameter part 171*a*, the base end flange part 172*d* slides only the inside of the cylinder large diameter part 171*b*. Thereby, the displacement distance of the displacing part 172 is regulated.

It should be noted that the fluid room 17*a* to which the fluid F, which will be described later, is supplied is formed by a space between the base end side of the base end flange part 172*d* and the extreme end surface 120*a* of the piston body 120.

As a driving source of the displacement mechanism 17, there is provided a fluid supply source (not illustrated) which supplies the fluid F. Examples of the fluid F include air and water. The fluid supply source supplies the fluid F to the fluid room 17*a* through a fluid supply path 120*c* which extends inside the piston body 120 in the axial direction of the piston body 120 and is open to the extreme end surface 120*a*.

The supply pressure of the fluid F supplied by the fluid supply source is controlled by the control device 70. Specifically, at the time of cleaning, the supply pressure of the fluid F is controlled at predetermined fixed supply pressure. In addition, the supply pressure of the fluid F is controlled to always have supply pressure higher than the pressure in the cylinder chamber 14 at the time of coating.

The circular seal part 15 is fit onto the extreme end periphery of the piston 12, specifically the circular seal part 15 is fit onto the periphery of the cylinder part 171 having the above structure. The seal part 15 includes: a seal body 151 made of insulating resin (for example, made of Teflon (registered trademark)); and a seal extreme end 152 which projects from the extreme end periphery of the seal body 151 to the extreme end side. Thereby, it is possible to avoid the electrically-conductive paint and the cleaning fluid W supplied into the cylinder chamber 14 from leaking outside.

The first hole 141 connected to the color switching valve mechanism 20 and the second hole 142 connected to the coating gun 60 are formed near the periphery edge of the extreme end 110 of the cylinder 11 at positions substantially symmetrical with each other with respect to the medial axis of the cylinder 11. In addition, the first hole 141 and the second hole 142 are respectively provided such that positions in the radial direction of the cylinder 11 are near the seal part 15 where the electrically-conductive paint tends to remain. Thereby, since the cleaning fluid W can be supplied near the seal part 15, cleaning efficiency improves.

As shown in FIG. 9 and FIG. 10, in the intermediate storage device 10 having the above structure, the extreme end surface 12*a* (172*a*) of the piston 12 slides until near the extreme end 110 of the cylinder 11 at the time of cleaning. Thereby, the cylinder chamber 14 is formed in a very small space between the extreme end surface 12*a* (172*a*) of the piston 12 and the extreme end 110 of the cylinder 11. The electrically-conductive paint remains in the cylinder chamber 14 having small volume and the remained electrically-conductive paint is removed by being cleaned by the cleaning fluid W at the time of cleaning.

Hereafter, with reference to FIG. 9, operation of the electrostatic coating device 1 at the time of cleaning the low viscosity paint when the pressure in the cylinder chamber 14 is lower than the supply pressure of the fluid F supplied into the cylinder chamber 14 will be described. In addition, with reference to FIG. 10, operation of the electrostatic coating device 1 at the time of cleaning the high viscosity paint when the pressure in the cylinder chamber 14 is higher than the supply pressure of the fluid F supplied into the cylinder chamber 14 will be described.

It should be noted that, in the present embodiment, the supply pressure of the fluid F is set to predetermined fixed supply pressure by the control device 70 at the time of cleaning. In addition, at the time of cleaning, cleaning is performed by the control device 70 in a state where the piston 12 is stopped, more specifically, in a state where the piston body 120 is stopped.

First, when the viscosity of the paint is low, there is a good flow of the cleaning fluid W which flows through inside the cylinder chamber 14 and the route pressure is low. Therefore, since the pressure in the cylinder chamber 14 is lower than the supply pressure of the fluid F, the displacing part 172 is not displaced and the position of the extreme end surface 12*a* (172*a*) of the piston 12 is not displaced with respect to the piston body 120 and the cylinder 11 as shown in FIG. 9. Thereby, a state where the gap C1 between the extreme end surface 12*a* (172*a*) of the piston 12 and the extreme end 110 of the cylinder 11 is small is maintained, and as a result, a state where the volume of the cylinder chamber 14 is small is maintained.

Figure 11:
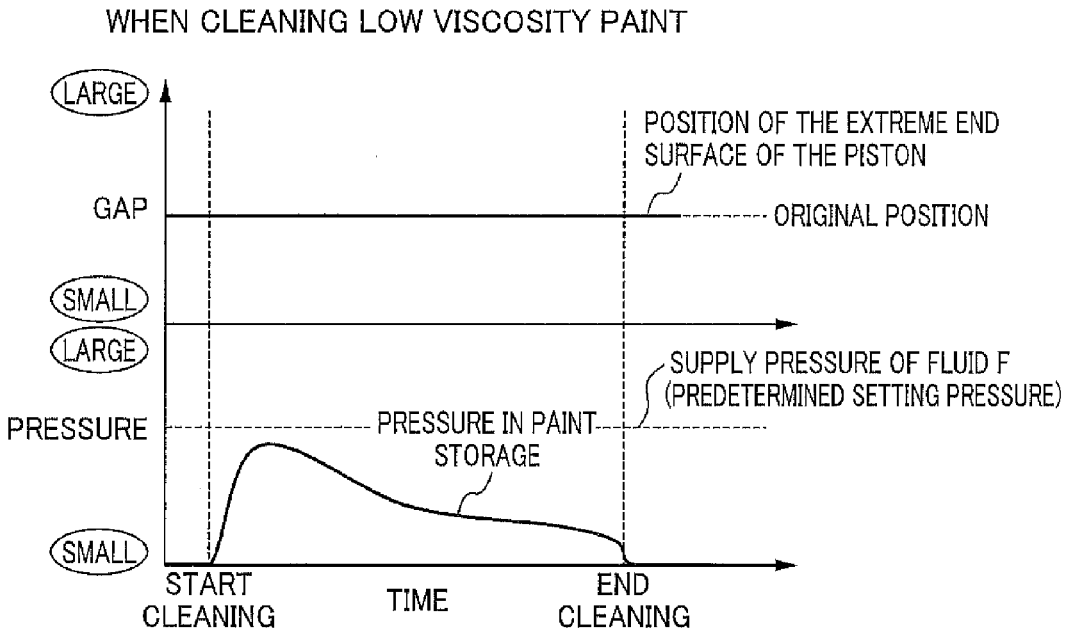
FIG. 11 is a diagram showing the relation between the pressure in the cylinder chamber and the position of the extreme end surface of the piston at the time of cleaning the low viscosity paint.

Here, FIG. 11 is a diagram showing the relation between the pressure in the cylinder chamber 14 and the position of the extreme end surface 12*a* (172*a*) of the piston 12 at the time of cleaning the low viscosity paint. As shown in FIG. 11, at the time of cleaning the low viscosity paint, although the pressure in the cylinder chamber 14 increases when the cleaning starts, the pressure in the cylinder chamber 14 does not exceed the supply pressure of the fluid F at all. Therefore, the displacing part 172 is not displaced and the position of the extreme end surface 12*a* (172*a*) of the piston 12 is not displaced with respect to the cylinder 11 and the piston body 120 and thus locates at the original position.

In contrast, when the viscosity of the paint is high, there is only a poor flow of the cleaning fluid W which flows through inside the cylinder chamber 14 and the route pressure is high.

Therefore, since the pressure in the cylinder chamber 14 is higher than the supply pressure of the fluid F, the displacing part 172 is displaced and the position of the extreme end surface 12*a* (172*a*) of the piston 12 is displaced with respect to the cylinder 11 and the piston body 120 as shown in FIG. 10. Specifically, the position of the extreme end surface 12*a* (172*a*) of the piston 12 is displaced with respect to the cylinder 11 and the piston body 120 to the base end side (upper side in FIG. 10). Thereby, the gap C2 between the extreme end surface 12*a* (172*a*) of the piston 12 and the extreme end 110 of the cylinder 11 becomes larger than C1 shown in FIG. 9, and as a result, the volume of the cylinder chamber 14 becomes larger.

Figure 12:
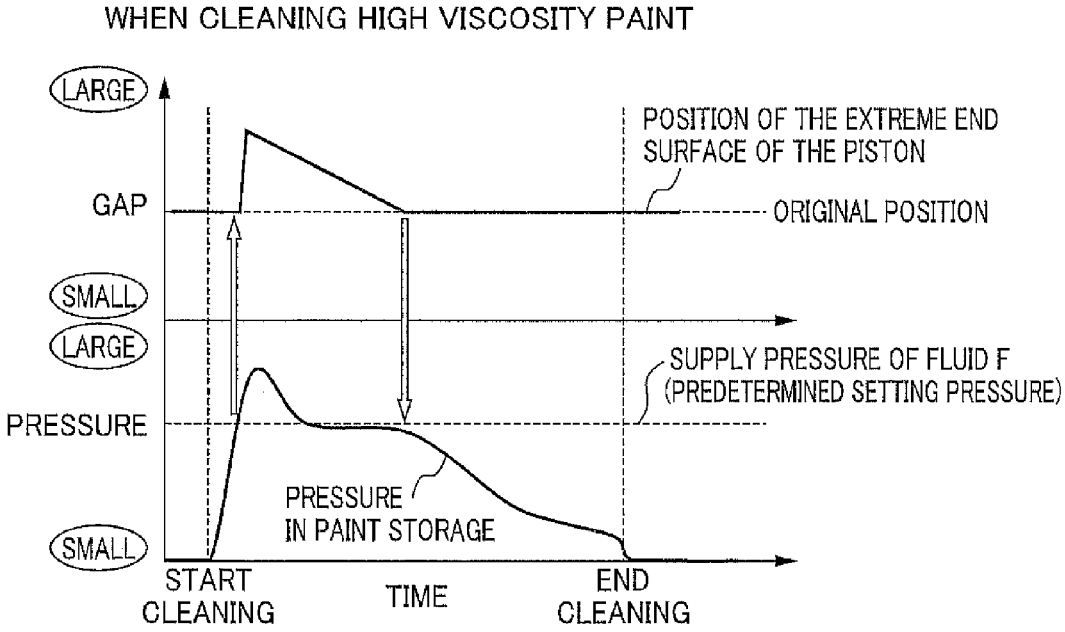
FIG. 12 is a diagram showing the relation between the pressure in the cylinder chamber and the position of the extreme end surface of the piston at the time of cleaning the high viscosity paint.

Here, FIG. 12 is a diagram showing the relation between the pressure in the cylinder chamber 14 and the position of the extreme end surface 12*a* (172*a*) of the piston 12 at the time of cleaning the high viscosity paint. As shown in FIG. 12, at the time of cleaning the high viscosity paint, the pressure in the cylinder chamber 14 increases when the cleaning starts and the pressure in the cylinder chamber 14 exceeds the supply pressure of the fluid F. Therefore, the displacing part 172 is displaced and the position of the extreme end surface 12*a* (172*a*) of the piston 12 is displaced with respect to the piston body 120 and the cylinder 11 to the base end side.

In addition, since the amount of the cleaning fluid W increases with respect to the electrically-conductive paint remaining in the cylinder chamber 14 and the viscosity of the remaining electrically-conductive paint is lowered when the position of the extreme end surface 12*a* (172*a*) of the piston 12 is displaced to the base end side, cleaning is promoted and cleaning efficiency improves. As shown in FIG. 12, since the pressure in the cylinder chamber 14 decreases and the pressure in the cylinder chamber 14 becomes lower than the supply pressure of the fluid F as the cleaning goes on, the displacing part 172 returns to the original position gradually. Thereby, the position of the extreme end surface 12*a* (172*a*) of the piston 12 returns to the original position also. That is, the size of the gap C2 between the extreme end surface 12*a* (172*a*) of the piston 12 and the extreme end 110 of the cylinder 11 returns to the size of C1 and the volume of the cylinder chamber 14 becomes in its original small state shown in FIG. 9.

Next, operation of the electrostatic coating device 1 at the time of coating will be described.

First, the first dumping valve 31, the second dumping valve 41 and the second trigger valve 42 are closed and one of the paint valves and the first trigger valve 32 are opened by the control device 70. In addition, the servo-motor 13 of the intermediate storage device 10 is driven by the control device 70. Thereby, the electrically-conductive paint of predetermined coating color is pressure-fed into the cylinder chamber 14 of the intermediate storage device 10 and the electrically-conductive paint is supplied to the second trigger valve 42.

Next, after completing filling of the electrically-conductive paint into the cylinder chamber 14, the voltage block mechanism (not illustrated) is controlled by the control device 70 to electrically insulate the color switching valve mechanism 20 and the intermediate storage device 10.

Next, with the control device 70, the second trigger valve 42 is opened and the piston 12 is advanced with respect to the cylinder 11 by the drive action of the servo-motor 13. Then, the electrically-conductive paint stored in the cylinder chamber 14 is pressure-fed towards the coating gun 60. The electrically-conductive paint pressure-fed by the coating gun 60 is applied with high voltage in the high voltage application unit and is discharged from the extreme end of the coating gun 60 in this state. Thereby, electrostatic coating of the electrically-conductive paint is carried out with respect to the object to be coated.

Here, at the time of paint discharge, the fluid supply source is controlled by the control device 70 such that the supply pressure of the fluid F is always higher than the pressure in the cylinder chamber 14. Thereby, the position of the extreme end surface 12*a* (172*a*) of the piston 12 is controlled such that it is not displaced and the amount of supply to the coating gun 60 is controlled accurately.

It should be noted that since impact is absorbed by the displacement mechanism 17 even when the extreme end of the piston 12 collides with the inner wall of the cylinder 11 or the like as a result of abnormalities or positional disagreement when advancing the piston 12 with respect to the cylinder 11, the affect of the piston body 120 and the servo-motor 13 is reduced.

After electrostatic coating is completed, the second trigger valve 42 is closed and the application of high voltage to the coating gun 60 is canceled. In addition, electric insulation between the color switching valve mechanism 20 and the intermediate storage device 10 by the voltage block mechanism is canceled.

Next, with the control device 70, the first cleaning valve 21, the first trigger valve 32 and the second dumping valve 41 are opened and the first dumping valve 31 and the second cleaning valve 51 are closed. Thereby, the cylinder chamber 14 is cleaned by supplying the cleaning fluid W from the first hole 141 and discharging from the second hole 142 the waste fluid that has undergone cleaning. In addition, in the present embodiment, in order to improve the cleaning efficiency of the cylinder chamber 14 as that of the first embodiment, the cylinder chamber 14 can be cleaned by switching with a switching unit of the control device 70 between a first cleaning which is performed by a first cleaning unit and supplies the cleaning fluid W from the first hole 141 and a second cleaning which is performed by a second cleaning unit and supplies the cleaning fluid W from the second hole 142. It should be noted that the first cleaning may be further performed after the second cleaning, and the first cleaning and the second cleaning may be repeated alternately.

Thus, electrostatic coating is performed by newly supplying electrically-conductive paint of different coating color in the same procedure as the above-described procedure after cleaning the cylinder chamber 14.

The present embodiment exerts the following advantageous effects.

In the present embodiment, there is provided a displacement mechanism 17 which displaces the position of the extreme end surface 12*a* (172*a*) of the piston 12 with respect to the cylinder 11 by displacing the position of the extreme end surface 12*a* (172*a*) of the piston 12 with respect to the piston body 120 when the pressure in the cylinder chamber 14 exceeds predetermined pressure, more specifically, predetermined fixed supply pressure of the fluid F, by filling the cleaning fluid W into the cylinder chamber 14.

According to the present embodiment, the electrically-conductive paint remaining in the cylinder chamber 14 at the time of cleaning serves as resistance to the flow of the cleaning fluid W causing the pressure in the cylinder chamber 14 to increase and exceed predetermined fixed supply pressure of the fluid F and the position of the extreme end surface 12*a* (172*a*) of the piston 12 with respect to the piston body 120 is displaced automatically without being controlled. Thereby, the position of the extreme end surface 12*a* (172*a*) of the piston 12 with respect to the cylinder 11 is displaced. Accordingly, since the volume in the cylinder chamber 14 increases and the amount of the cleaning fluid W with respect to the electrically-conductive paint remaining in the cylinder chamber 14 increases causing the viscosity of the electrically-conductive paint to be lowered, cleaning efficiency can be improved. Therefore, according to the present embodiment, it is possible to clean inside the cylinder chamber 14 effectively irrespective of the type of electrically-conductive paint.

In addition, the present embodiment controls such that the position of the extreme end surface 12*a* of the piston 12 with respect to the piston body 120 is not displaced during the coating, that is, when extruding the electrically-conductive paint filled inside the cylinder chamber 14.

According to the present embodiment, since the position of the extreme end surface 12*a* (172*a*) of the piston 12 with respect to the piston body 120 is not displaced during the coating, it is possible to supply an accurate amount of electrically-conductive paint to the coating gun 60.

In addition, according to the method for coating that uses the electrostatic coating device 1 in the present embodiment, it is possible to clean the cylinder chamber 14 efficiently irrespective of the type of electrically-conductive paint by filling the cleaning fluid W in the cylinder chamber 14 at the time of cleaning and displacing the position of the extreme end surface 12*a* (172*a*) of the piston 12 with respect to the cylinder 11.

Sixth Embodiment

The electrostatic coating device according to the sixth embodiment has the same structure as the fifth embodiment except that the structure of the displacement mechanism is different from that of the fifth embodiment.

Figure 13:
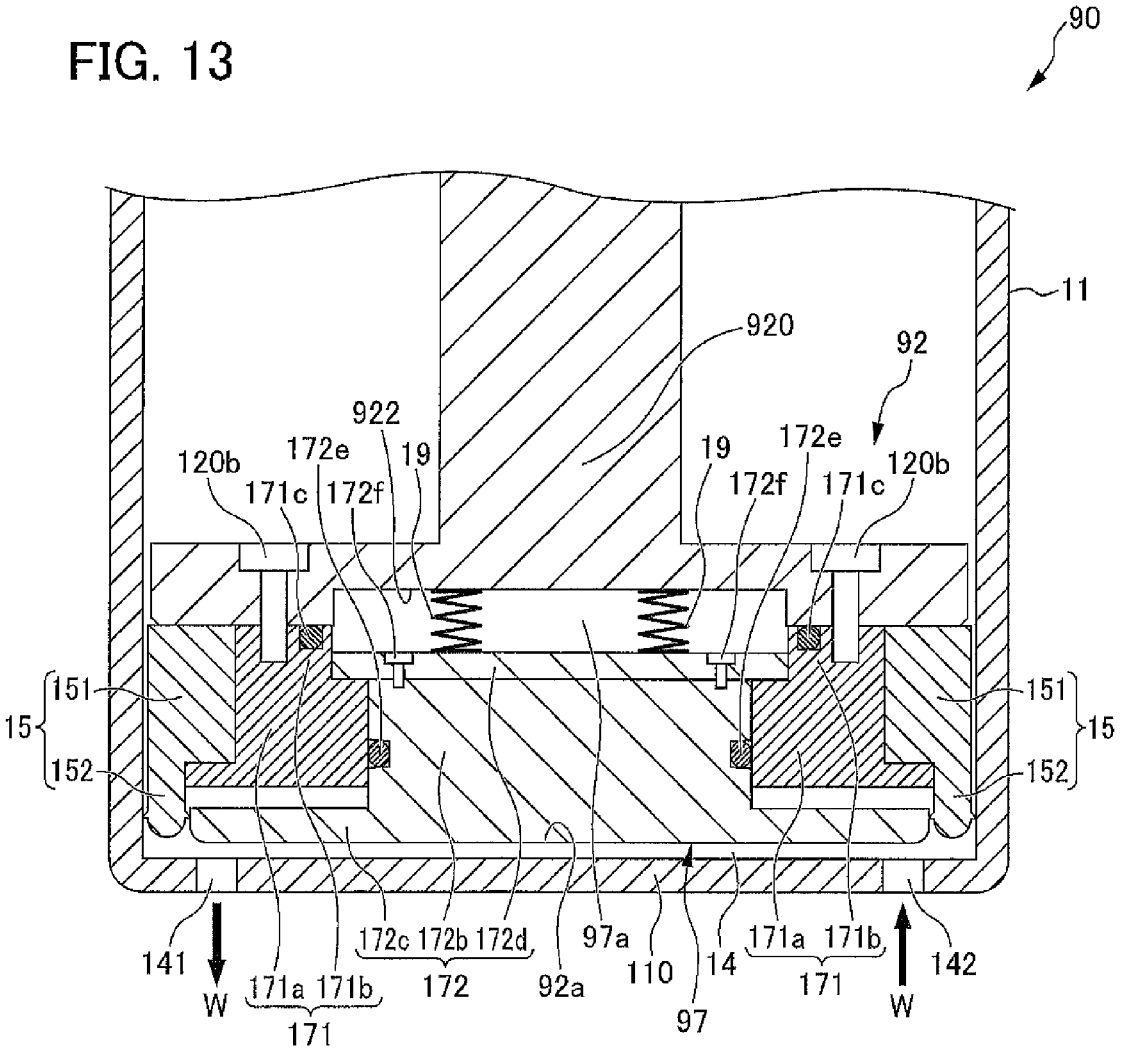
FIG. 13 is an enlarged cross-sectional view of the intermediate storage device according to the fifth embodiment.

FIG. 13 is an enlarged cross-sectional view of the intermediate storage device 90 of the electrostatic coating device according to the second embodiment. As shown in FIG. 13, in contrast to the fluid supply source of the fluid F of the fifth embodiment, the driving source of the displacement mechanism 97 included in the intermediate storage device 90 includes an elastic body 19 having, for example, a plurality of compression springs. Therefore, the fluid supply path is not formed inside the piston body 920.

A plurality of elastic bodies 19 are provided in an elastic room 97*a* which is larger than the fluid room 17*a* in the fifth embodiment. The elastic room 97*a* is formed between a concave portion 922 formed depressed to the base end side on the extreme end surface of the piston body 920 and a base end flange part 172*d* of the displacing part 172.

A plurality of elastic bodies 19 pushes the displacing part 172 to the extreme end side in an initial state which is before coating. Thereby, as shown in FIG. 13, in the initial state before coating, the extreme end surface of the base end flange part 172*d* contacts with the base end surface of the cylinder small diameter part 171*a* and the displacing part 172 is arranged at the most extreme end side.

In addition, in the present embodiment, at the time of cleaning, the displacing part 172 is displaced automatically without being controlled when the cleaning fluid W is filled in the cylinder chamber 14 and the pressure in the cylinder chamber 14 exceeds the pushing force. Specifically, the position of the extreme end surface 92*a* of the piston 92 with respect to the cylinder 11 can be automatically displaced to the base end side by displacing the position of the extreme end surface 92*a* of the piston 92 with respect to the piston body 920 automatically to the base end side.

In addition, when the position of the extreme end surface 92*a* of the piston 92 is displaced to the base end side, the amount of the cleaning fluid W with respect to the electrically-conductive paint remaining in the cylinder chamber 14 increases and the viscosity of the remained electrically-conductive paint is lowered and thus cleaning is promoted and cleaning efficiency improves. As the cleaning progresses, the pressure in the cylinder chamber 14 decreases and the pressure in the cylinder chamber 14 becomes lower than the pushing force of the plurality of elastic bodies 19, and thus the displacing part 172 returns to the original position gradually and the position of the extreme end surface 92*a* of the piston 92 returns to the original position.

Therefore, the present embodiment exerts the same advantageous effects as the fifth embodiment at the time of cleaning with a structure simpler than the fifth embodiment.

The present invention is not limited to the above-described embodiments and the present invention includes modifications, improvements and the like within the range that can accomplish the object of the present invention.

For example, although fluid F is used as a driving source of the displacement mechanism in the fifth embodiment and a plurality of elastic bodies are used as a driving source of the displacement mechanism in the sixth embodiment, the present invention is not limited thereto. Instead of the fluid F or the elastic bodies, a motor can be used as a driving source of the displacement mechanism. When using the motor as a driving source of the displacement mechanism, a pressure detection means which detects the pressure in the cylinder chamber may be provided to control the rotation speed of the motor by the control device based on the detected values.

Specifically, the rotation speed of the motor may be controlled such that, at the time of cleaning, the control device suppresses the rotation speed when the detected pressure in the detected cylinder chamber reaches predetermined pressure, and at the time of coating, the position of the extreme end surface of the piston with respect to the cylinder is not displaced according to the detected pressure in the cylinder chamber.

What is claimed is:

1. An intermediate storage device of an electrostatic coating system, comprising:

a cylinder which is provided between a paint supply source and a coating gun and stores paint;

a piston which can slide inside a cylinder chamber of the cylinder, wherein the cylinder chamber is formed inside the cylinder; and a driving source which drives the piston, the intermediate storage device further comprises:

a first hole which is open to the cylinder chamber and is connected to the paint supply source;

a second hole which is open to the cylinder chamber and is connected to the coating gun, wherein the first hole and the second hole are arranged on mutually opposite sides of a circumference of the cylinder, and an opening diameter of the first hole and an opening diameter of the second hole are different so as to improve cleaning efficiency of the cylinder chamber;

a first cleaning device having a first cleaning valve for controlling a supply of a cleaning fluid and drying air by a flow in a first direction toward the first hole so as to clean the cylinder chamber by supplying the cleaning fluid from the first hole and discharging from the second hole waste fluid that has undergone cleaning;

a second cleaning device having a second cleaning valve for controlling the supply of the cleaning fluid and the drying air by a flow in a second direction toward the second hole so as to clean the cylinder chamber by supplying the cleaning fluid from the second hole and discharging from the first hole waste fluid that has undergone cleaning; and a switch device that switches between cleaning performed by the first cleaning device and cleaning performed by the second cleaning device.

2. The intermediate storage device of an electrostatic coating system according to claim 1, further comprising an annular seal member which fits into an outer peripheral of an extreme end of the piston, wherein an extreme end surface of the seal member opposing an extreme end of the cylinder is formed substantially in-plane with an extreme end surface of the piston, whereby a length of the cylinder chamber in a direction of the cylinder axis can be made substantially uniform while securing the flow of the cleaning fluid.

3. The intermediate storage device of an electrostatic coating system according to claim 1, further comprising a driving source controller that drives the piston by controlling the driving source during cleaning performed by the first cleaning device and cleaning performed by the second cleaning device.

4. The intermediate storage device of an electrostatic coating system according to claim 1, further comprising a displacement mechanism including an inner cylinder part fixed onto an extreme end surface of a body of the piston and a displacing part, an end portion of which forms the extreme end surface of the piston, to be capable of displacing relative to the inner cylinder part, and wherein the displacement mechanism displaces a position of the extreme end surface of the piston with respect to the cylinder by displacing the position of the extreme end surface of the piston with respect to the body of the piston.

5. The intermediate storage device of an electrostatic coating system according to claim 4, further comprising a controller that controls the displacement mechanism such that the position of the extreme end surface of the piston with respect to the body of the piston is not displaced during coating, whereby an amount of supply to the coating gun is controlled accurately.

6. The intermediate storage device of an electrostatic coating system according to claim 2, further comprising a driving source controller that drives the piston by controlling the driving source during cleaning performed by the first cleaning device and cleaning performed by the second cleaning device.

* * * * *